US006819317B1

(12) United States Patent
Komura et al.

(10) Patent No.: US 6,819,317 B1
(45) Date of Patent: Nov. 16, 2004

(54) LIQUID CRYSTAL DISPLAY AND DRIVE METHOD THEREOF

(75) Inventors: Shinichi Komura, Hitachi (JP); Yoshiro Mikami, Hitachoita (JP); Hideo Satou, Hitachi (JP); Minoru Hoshino, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 259 days.

(21) Appl. No.: 09/692,451

(22) Filed: Oct. 20, 2000

(30) Foreign Application Priority Data

Oct. 25, 1999 (JP) ..... 11-303078

(51) Int. Cl.[7] ..... G09G 5/00
(52) U.S. Cl. ..... 345/204; 345/92; 345/206
(58) Field of Search ..... 345/92, 94, 96, 345/99, 205, 206, 208, 212, 213, 98, 100, 204, 89, 147

(56) References Cited

U.S. PATENT DOCUMENTS 4,087,792 A * 5/1978 Asars ..... 340/166
5,666,133 A * 9/1997 Matsuo et al. ..... 345/100
5,686,932 A * 11/1997 Tomita ..... 345/94
5,844,535 A * 12/1998 Itoh et al. ..... 345/92
6,115,017 A * 9/2000 Mikami et al. ..... 345/92
6,160,533 A * 12/2000 Tamai et al. ..... 345/89
6,166,726 A * 12/2000 Uchida et al. ..... 345/211

FOREIGN PATENT DOCUMENTS

JP 09-258168 10/1997

* cited by examiner

*Primary Examiner*—Regina Liang
*Assistant Examiner*—Jennifer T. Nguyen
(74) *Attorney, Agent, or Firm*—Antonelli, Terry, Stout & Kraus, LLP

(57) ABSTRACT

A liquid crystal display wherein display is performed based on the fact that an a.c. voltage is applied to a liquid crystal layer when a switching element establishes a connection between a display electrode and a common electrode, and the a.c. voltage is not applied to the liquid crystal layer when the switching element releases the connection between the display electrode and the common electrode. A state of the switching element changes from connection between the display electrode and the common electrode to release of the connection under a condition that respective voltages of an opposite electrode, the display electrode, and the common electrode are made substantially the same, the condition being produced by stopping an a.c. voltage applied to the opposite electrode.

20 Claims, 17 Drawing Sheets

LIQUID CRYSTAL DISPLAY AND DRIVE METHOD THEREOF

BACKGROUND OF THE INVENTION

1. Field of the Invention

The present invention refers to a liquid crystal display and drive method thereof, and particularly to a TFT active matrix display and drive method thereof for low power consumption.

2. Related Background Art

A prior art liquid crystal display is disclosed, for example, as a liquid crystal display to get a high definition display image in the Official Gazette of Japanese Patent Laid-Open NO. 133629/1998 discloses. Another example is disclosed in the Official Gazette of Japanese Patent Laid-Open NO. 113876/1997 where a polarity inversion circuit is connected to an opposite electrode to ensure stable operation and low power loss. The Official Gazette of Japanese Patent Laid-Open NO.104246/1995 discloses an active matrix liquid crystal drive for lower power consumption.

The following describes the prior art TFT active matrix drive system:

A line sequential scanning system is used to drive the TFT active matrix liquid crystal display, and one scanning pulse is applied to each scanning electrode for each frame time. About 1/60 second is appropriate as one frame time. These pulses are applied downwardly from the top of the panel to the bottom in sequence at differently timed intervals. Consequently, 480 gate wires are scanned in one frame in a liquid crystal display having a 640×480-dot pixel configuration, so the time range of the scanning pulse is about 35 microseconds.

Meanwhile, the liquid crystal drive voltages applied to liquid crystals for one-row pixels where scanning pulses are applied are simultaneously applied to the signal electrode in synchronization with scanning pulses. In the selection pixel where gate pulses are applied, the gate electrode voltage of the TFT connected to the scanning electrode is increased to turn on the TFT. In this case, liquid crystal drive voltage is applied the display electrode via the source and drain of the TFT to charge the pixel capacity comprising the liquid crystal capacity formed between the display electrode and opposite electrode formed on the opposite substrate, plus load capacity assigned to the pixel. This operation is repeated to allow liquid crystal application voltage to be applied repeatedly to the pixel capacity of the all panel surfaces for each frame time.

Since a.c. voltage is required to drive the liquid crystal, the voltage with the polarity inverted for each frame time is applied to the signal electrode. As a result, even if the image to be displayed does not change, much of the power to drive the panel is consumed to repeatedly charge or discharge, at every gate selection, the capacity at the crossing portion between scanning and signal lines or the capacity of the liquid crystal between the line and the opposite electrode formed on all surfaces of on the opposite substrate.

The Official Gazette of Japanese Patent Laid-Open NO.258168/1997 discloses a technology to solve said problem and to implement a liquid crystal display of lower power consumption.

The liquid crystal display disclosed in the Official Gazette of Japanese Patent Laid-Open NO.258168/1997 has the following components in each of the pixel areas enclosed by multiple scanning electrodes and multiple signal electrodes of a substrate; (1) a display data retention circuit connected to corresponding scanning electrodes and signal electrodes to capture and retain the display data from signal electrodes in response to scanning signals, (2) a switching element connected to the display data retention circuit wherein switching operation is controlled by said circuit, and (3) a display electrode connected to the switching element. Display electrode drive voltage is changed in response to the data retained by the display data retention circuit, thereby controlling pixel indications.

The display data retention circuit has a sampling TFT where the gate is connected to the corresponding scanning electrode and the drain is connected to the corresponding electrode, and a sampling capacitor connected to the sampling TFT source. The switching element has a switching TFT where the gate is connected to the source of the display data retention circuit and the source is connected to said display electrode. The sampling capacitor comprising said display data retention circuit and the drain of the switching TFT connected to the display electrode are connected to the common electrode.

The display data retention circuit sends to the sampling capacitor via the sampling TFT the display data signal voltage fed from the signal electrode in synchronism with the scanning signal to select the scanning electrode, and retains the pixel display data as voltage information.

The liquid crystal drive voltage controlling the light and dark pattern of the pixel is determined by a.c. voltage applied to the liquid crystal held closely between the display electrode and opposite electrode. When liquid crystal drive power voltage is applied to the opposite electrode, the voltage is applied to the liquid crystal if the switching TFT is on, but not applied to the liquid crystal if said switching TFT is off. This arrangement allows liquid crystal applied voltage of each pixel to be controlled by the display data signal voltage in the pixel.

In this case, the display data retention circuit can continue to retain the display data until voltage across the sampling capacitor as display data signal voltage is discharged below the threshold voltage of the switching TFT due to leakage of switching TFT or the like. Time until said discharge occurs depends on the leakage current value of the switching TFT and the capacity of the sampling capacitor. Normally, the TFT leakage current value is very small, but is sufficiently longer than 16.6 ms—a representative value of frame time. Moreover, liquid crystal drive voltage can be applied to all pixels in one operation from the opposite electrode. For pixels where display contents do not change, display can be maintained by application of liquid crystal drive voltage alone if the display data signal voltage is changed and the switching TFT is turned on or off. Scanning signal and display data signal voltage should be applied only when display contents are to be rewritten. This ensures excellent display while keeping low power consumption inside the panel.

However, said prior art has a problem that much is required to rewrite the image in response to changes of display contents.

Voltage across the sampling capacitor changes in response to changes of display contents, and this involves changes in the state of the switching TFT. In this case, if the switching TFT changes from OFF to ON state, the voltage of the display electrode will become the same as that of the common electrode immediately. Voltage will be applied to the liquid crystal to get the desired display.

However, if switching TFT is changed from the ON to OFF state, the display electrode is in the floating mode while voltage between the display electrode and opposite electrode is retained, so d.c. voltage will be applied to the liquid crystal between the display electrode and opposite electrode. The desired display cannot be obtained. This d.c. voltage is reduced by liquid crystal leakage, but the time constant for this reduction is long. Complete switching takes much time.

Although the TFT leakage current is very small, it is not zero. The voltage stored in the sampling capacitor cannot be retained for a long time. This makes it necessary to make up for the voltage reduced by leakage whenever required, even if there is no change in display contents. In other words, overwriting is sometimes necessary. When overwriting, the voltage of the sampling capacitor is changed by making up for it. However, if this change affects the state of the switching TFT, the image will change; this is not preferred. In other words, this requires the sampling capacitor voltage to be overwritten without changing the state of the switching TFT.

When overwriting, pulse signals are normally applied to the scanning electrode, and voltage corresponding to the display of pixels for one row is applied to the signal electrode in one operation in synchronism with pulse signals. In this case, a latch circuit is required to output the synchronized voltage to the signal electrode. If the drive circuits of the signal electrode and scanning electrode are built in the liquid crystal panel using a polysilicon or the like, it is preferred to omit the use of the latch circuit, thereby reducing the circuit size. In this case, the voltage of the scanning electrode in the corresponding row is reduced below the threshold value of the sampling TFT, and the signal electrode voltage is rewritten into voltage corresponding to the display for the row. However, the following operation error will occur in this case.

According to the method where the latch circuit, voltage corresponding to the display of pixels on the same column of the preceding row remains in the signal electrode when the voltage of the scanning electrode is reduced below the threshold value of the sampling TFT. Consequently, the data corresponding to pixels on the same column of the preceding row will be written into the sampling capacitor. Normally, the desired data are written immediately thereafter, so there is no problem. If the display data in the same column of the preceding row is on, and the display data to be written is off, then an operation error will occur.

Namely, the switching TFT changes from ON to OFF state with a.c. voltage applied to the liquid crystal. So d.c. voltage is applied to the liquid crystal between the display electrode and opposite electrode as described above, with the result that the desired display cannot be obtained.

According to said technology, the switching TFT may be turned off depending on the screen to be displayed. Since the power of the liquid crystal display is turned on, for example, unwanted d.c. voltage having occurred when power is turned on will remain applied to the electrode of the pixel where the switching TFT is off. If the pixel electrode is always kept is in the floating mode during the drive, the voltage will become unstable. This is not to be preferred.

Problems described above are unique to said technology where display is given with the pixel electrode kept in the floating mode. Such problems do not occur in the prior art technologies disclosed in the Official Gazette of Japanese Patent Laid-Open NO.133629/1998, Official Gazette of Japanese Patent Laid-Open NO.113876/1997 and Official Gazette of Japanese Patent Laid-Open NO.104246/1997 where switching elements are not used.

SUMMARY OF THE INVENTION

The object of the present invention is to provide a liquid crystal display and drive method thereof, featuring a lower power consumption and high speed display switching, based on the method where display is performed with the pixel electrode kept in the floating mode.

Another object of the present invention is to provide a liquid crystal display and drive method thereof, featuring a lower power consumption and high speed display switching, based on the method where display is performed with the pixel electrode kept in the floating mode; said liquid crystal display further characterized by a simple circuit configuration and a function of preventing d.c. voltage from being applied to the liquid crystal when the switching TFT is changed from ON to OFF state.

Still another object of the present invention is to provide a liquid crystal display and drive method thereof, featuring a lower power consumption and high speed display switching, based on the method where display is performed with the pixel electrode kept in the floating mode; said liquid crystal display further characterized by a function of preventing d.c. voltage from being applied to the liquid crystal of the pixel where the switching TFT is always off.

The present invention is characterized a liquid crystal display comprising (1) a switching element connected to a display data retention circuit, common electrode and display electrode, said switching element controlling said common electrode and said display electrode according to the voltage retained in said display data retention circuit, and (2) an opposite electrode installed opposite to said display electrode where a.c. voltage vibrating in response to the voltage of said common electrode is applied; wherein display is performed based on the fact that a.c., voltage is applied to a liquid crystal layer when said switching element connects between said display electrode and common electrode, and a.c. voltage is not applied to said liquid crystal layer when said switching element releases connection between said display electrode and said common electrode; said liquid crystal display further characterized in that the state of said switching element is changed from connection between said display electrode and said common electrode to release of said connection, when the voltages of said opposite electrode, said display electrode and said common electrode are made substantially the same by stopping said a.c. voltage applied to said opposite electrode.

The liquid crystal display according to the present invention has the following components in each of the pixel areas enclosed by multiple scanning electrodes and multiple signal electrodes of a substrate; (1) a display data retention circuit connected to corresponding scanning electrodes and signal electrodes to capture and retain the display data from signal electrodes in response to scanning signals, (2) a switching element connected to the display data retention circuit wherein switching operation is controlled by said circuit, and (3) a display electrode connected to the switching element. Display electrode voltage is changed in response to the data retained by the display data retention circuit, thereby controlling pixel indications.

The display data retention circuit has a sampling TFT where the gate is connected to the corresponding scanning electrode and the drain is connected to the corresponding signal electrode, and a sampling capacitor connected to the sampling TFT source. The switching element has a switching TFT where the gate is connected to the source of the sampling TFT of the display data retention circuit and the source is connected to said display electrode. The sampling capacitor comprising said display data retention circuit and the switching TFT connected to the display electrode are connected to the common electrode.

The display data retention circuit captures into the sampling capacitor and retains therein the display data signal voltage fed from the corresponding signal electrode by making the voltage of the corresponding scanning electrode equal to or greater than the threshold value of the sampling TFT. This operation is repeated by scanning row by row to write display data to all pixels. The liquid crystal drive voltage controlling the light and dark pattern of the pixel is determined by a.c. voltage applied to the liquid crystal held closely between the display electrode and opposite electrode.

When liquid crystal drive power voltage is applied to the opposite electrode, the voltage is applied to the liquid crystal if the switching TFT is on, but not applied to the liquid crystal if said switching TFT is off.

The liquid crystal display according to the present invention is characterized in that voltages of the opposite electrode and display electrode are made substantially the same as that of the common electrode when the switching TFT is changed from ON to OFF state. In this case, voltages of the display electrode voltage and common electrode are the same with each other when the switching TFT is on. Consequently, voltages of these three components are made substantially the same if the opposite electrode voltage is made substantially the same as those of the display electrode and common electrode. Said expression "Voltages of these three components are made substantially the same" also means that the voltage applied to the liquid crystal layer, namely, the difference of voltages between the opposite electrode and display electrode (and common electrode) is made not to exceed the threshold value, in addition to the fact that the opposite electrode voltage is made the same as the display electrode voltage (and common electrode voltage).

As described above, if the opposite electrode and display electrode voltages are made substantially the same as that of the common electrode when the switching TFT is changed from ON to OFF state, the display electrode voltage is the same as the common electrode voltage, even if the switching TFT is changed from ON to OFF to keep the display electrode in the floating mode. So d.c. voltage is not applied to the liquid crystal as discussed in the above description of problems.

Drive is given to ensure data of the data retention circuit is rewritten without voltage applied to the liquid crystal, by making the voltages of the opposite electrode and display electrode the same as that of the common electrode when display has switched. As a result, voltage applied to the liquid crystal is zero, even if the switching TFT is changed from ON to OFF state to keep the display electrode in the floating mode. So d.c. voltage is not applied to the liquid crystal as discussed in the above description of problems. If a.c. voltage is applied to the opposite electrode after all data have been rewritten, a.c. voltage is applied to the liquid crystal where the switching TFT is on, and no voltage is applied to the liquid crystal where the switching TFT is off. Then a desired display is selected.

Another type of the liquid crystal display according to the present invention uses a circuit which turns off all switching TFTs after display electrode voltages in all pixel areas are simultaneously made the same as common electrode voltage. When display is switched, switching TFTs are turned off after display electrode voltages in all pixel areas are made the same as common electrode voltage. Under this condition, data stored in the display data retention circuit are rewritten. In this case, the state of the switching TFT is changed while a.c. voltage is applied to the liquid crystal. All switching TFTs are off before data are rewritten. During data rewriting, the state does not change from ON to OFF. In other words, this eliminates the possibility of the problem which may occur when the switching TFT is changed from ON to OFF state.

When the display data of the display data retention circuit is rewritten with a.c. voltage applied to the liquid crystal, or the same display data is overwritten with a.c. voltage applied to the liquid crystal in order to make up for the voltage stored in the sampling capacitor reduced by leakage, data corresponding to the pixel in the same column of the preceding row may be written, if the scanning electrode has reached the threshold value or has exceeded it while the display data signal voltage corresponding to the pixel in the same column of the preceding row still remains in the signal electrode. Normally, the desired data are written immediately thereafter, so there is no problem. If the display data on the same column of the preceding row is on, and the display data to be written is off, then said problem will occur. Namely, the switching TFT changes from ON to OFF state with a.c. voltage applied to the liquid crystal. So d.c. voltage is applied to the liquid crystal as described above, with the result that the desired display cannot be obtained.

To solve this problem, still another type of the liquid crystal display according to the present invention has a latch circuit installed to the signal data write circuit to synchronize the scanning electrode voltage with signal electrode voltage. This ensures that voltage not exceeding the threshold value of the sampling TFT will not be applied to the scanning electrode, when the data of the preceding row remains in the signal electrode.

However, installation of a latch circuit increases the circuit size of the signal data write circuit, so this is not appropriate when the circuit is built in the liquid crystal panel using polysilicon or the like. To solve this problem, the present invention proposes a method which does not use a circuit; a method of resetting the signal electrode voltage to the OFF display data signal voltage for each writing into one row. This ensures all signal electrode voltages are OFF display signal voltage when the scanning electrode voltage is equal to or greater than the threshold value of the sampling TFT, so all the switching TFTs of that row will be turned off. If the original state is on in this case, the state will change from ON to OFF, said problem will occur. However, "ON" will be written immediately thereafter and d.c. voltage is applied only momentarily, so there is no problem.

Another method of solving this problem according to other characteristic of the present invention without installing a latch circuit provides a driving scheme which makes the scanning electrode voltage equal to or greater than the threshold value of the sampling TFT after desired display data signal voltages have been written to all signal electrodes. Furthermore, said problem can be solved, without installation of a latch circuit, by a drive scheme of making the opposite electrode voltage equal to the common electrode voltage at the time of rewriting and overwriting.

The liquid crystal display according to the present invention reduces power consumption by reducing the time period of rewriting or overwriting the display data of the display data retention circuit. The present invention provides a liquid crystal display which reduces the time period of rewriting or overwriting the display data by inputting the address data of the black or white display pixel, instead of inputting the display data corresponding to all pixels.

A further type of the liquid crystal display according to the present invention has a circuit which turns off the switching TFT in said pixel area for at least one row after the display electrode voltages in the pixel area for at least one row are simultaneously made equal to the common electrode voltage. When data is written into the display data retention circuit, the switching TFT is turned off after the display electrode voltage in said pixel area for at least one row is made equal to the common electrode voltage. In that state, data are written to the display data retention circuit in the pixel area for at least one row. In this case, the state of the switching TFT is changed while a.c. voltage is applied to the liquid crystal. The switching TFT is off before data is rewritten. During data rewriting, the state does not change from ON to OFF. In other words, this eliminates the possibility of the problem which may occur when the switching TFT is changed from ON to OFF state. The above operations are performed for all rows and data are written to data retention circuits in all pixel areas. As described above, driving the liquid crystal display allows all display electrodes to be electrically connected with the common electrode every time data is always written to the corresponding display data retention circuit. This eliminates the possibility of the problem of d.c. voltage which may occur the switching TFT based on said technology is off.

DETAILED DESCRIPTION OF PREFERRED EMBODIMENTS

Embodiments of the liquid crystal display according to the present invention will be described with reference to Figures:

Embodiment 1

Figure 1:
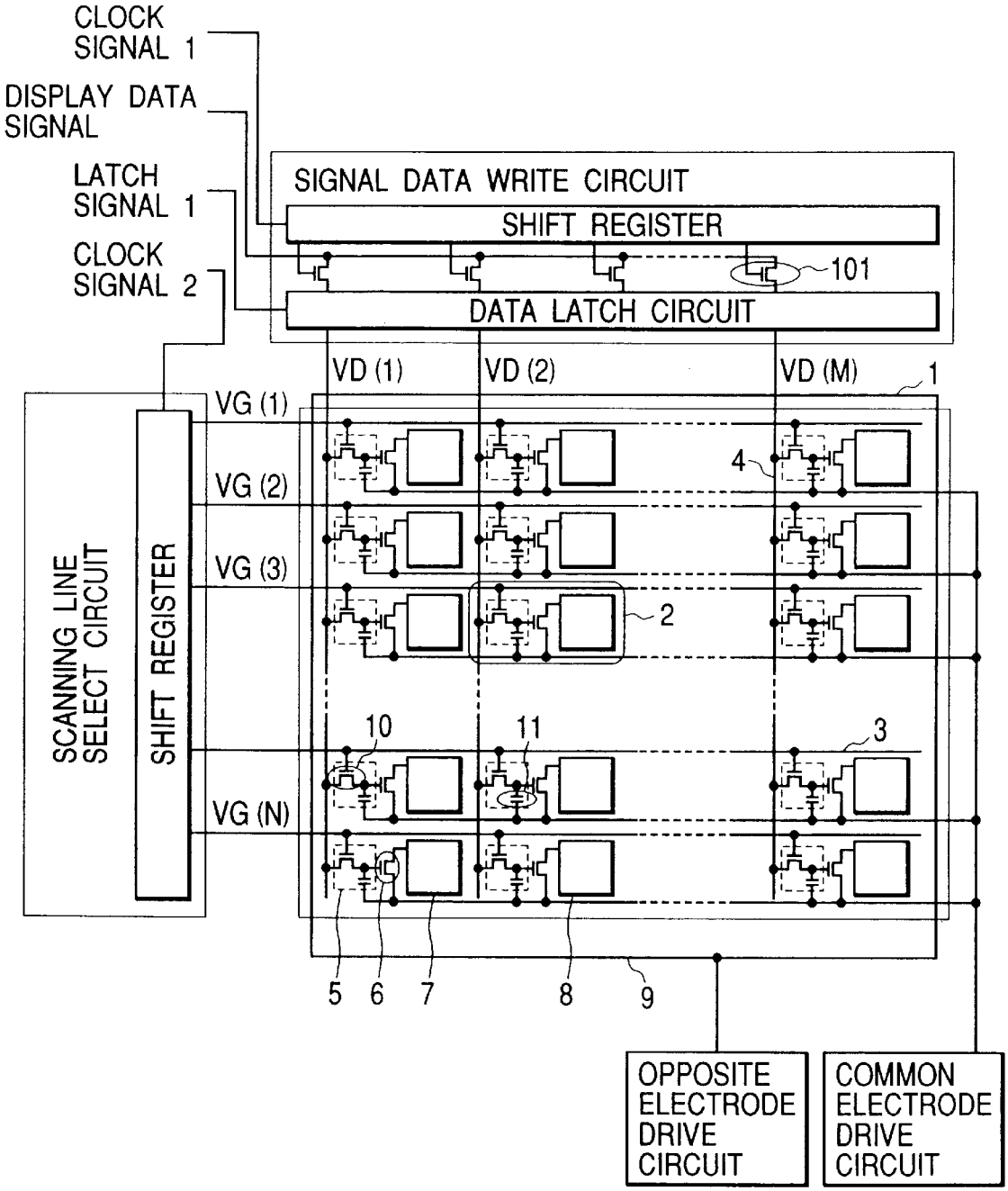
FIG. 1 is a block diagram representing the configuration of the first Embodiment according to the present invention.
Figure 2:
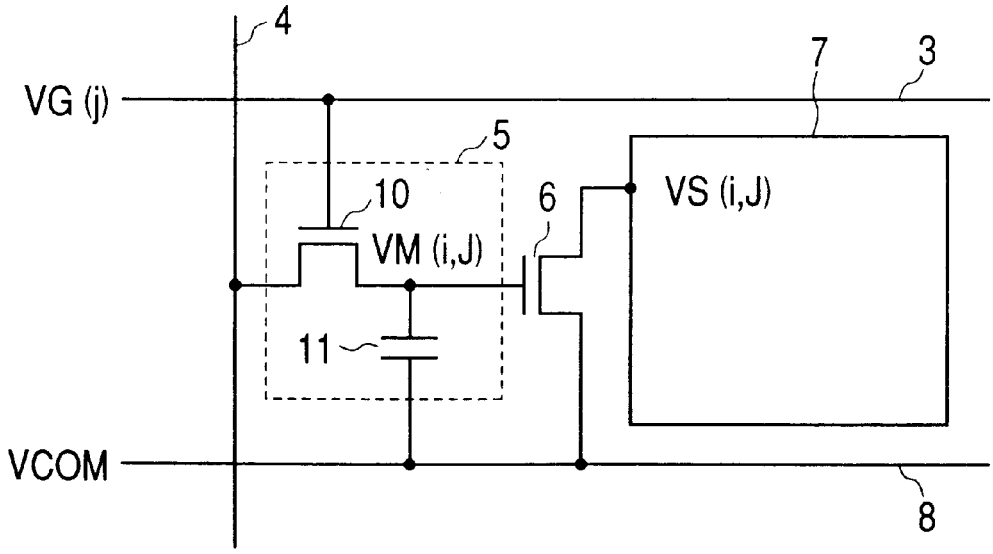
FIG. 2 shows a circuit configuration of the pixel unit given in FIG. 1.

FIG. 1 is a block diagram representing the first Embodiment of the liquid crystal display according to the present invention, and FIG. 2 is a circuit configuration view representing the pixel unit given in FIG. 1. A pixel unit 2 are arranged in a matrix of N-row×M-column dots on display unit 1 formed on the TFT substrate. Inside the pixel unit 2, a display data retention circuit 5 comprising a sampling TFT 10 and a sampling capacitor 11, a switching TFT 6, and display electrode 7 used for display are laid out at the crossing point between a scanning electrode 3 and a signal electrode 4. Each scanning electrode is connected to a scanning line selection circuit, and each signal electrode is connected to the signal data write circuit.

The signal data write circuit comprises a shift register to issue outputs in response to clock signal 1, a display data signal sampling TFT 101 to sample display data signal in response to shift register outputs, and a data latch circuit which synchronizes the display data signal sampling TFT 101 output with the latch signal and issues voltage VD (i) to the signal electrode in the first column. The scanning line selection circuit consists of a shift register which produces VG(j) to the scanning electrode of the J-th row in response to clock signal 2.

Common electrodes 8 are arranged in common for each row in parallel with scanning electrodes 3, and are connected with one another for connection of all pixels in common. Voltage VCOM is applied by the common electrode drive circuit. From the opposite electrode drive circuit, voltage VC is applied to opposite electrode 9 on the opposite substrate installed opposite to a display electrode 7 on the TFT substrate holding the liquid crystal in-between. Forming these circuits integrally on the TFT substrate using the TFT is effective in reducing the size of the display. It is also possible to use combination with the LSI individually.

Although not illustrated except for the opposite substrate, a phase plate and polarizing plate are arranged to constitute a reflective type liquid crystal display. In the present Embodiment, a quarter wave plate is used as a phase plate to ensure that black is displayed while voltage is applied to the liquid crystal, and white is displayed when not applied. Setting is made so that the optical axis of the phase plate and the absorption plate of the polarizing plate have an angle of 45 degrees.

Figure 3:
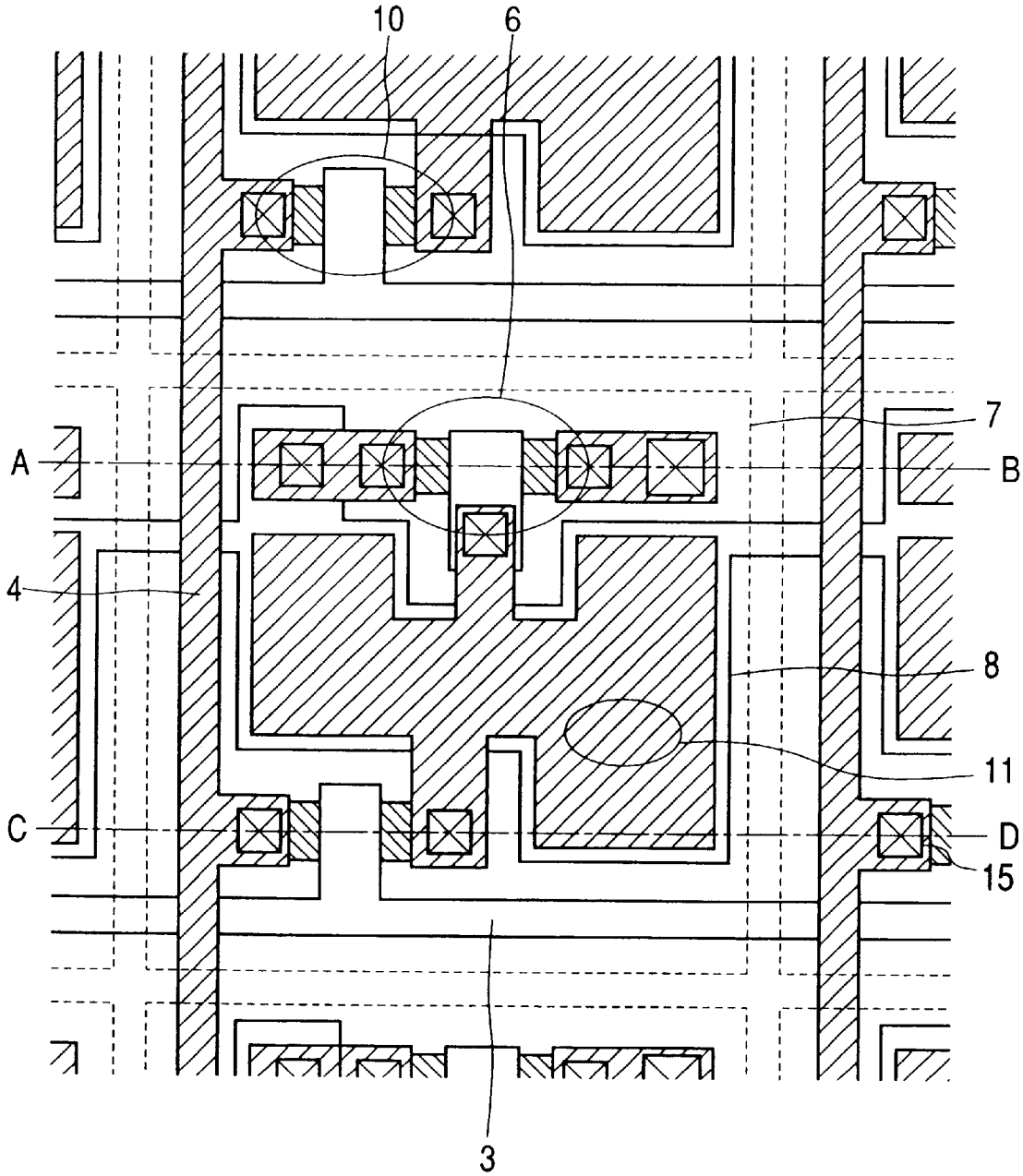
FIG. 3 is a drawing representing a mask pattern of the pixel given in FIG. 2.
Figure 4:
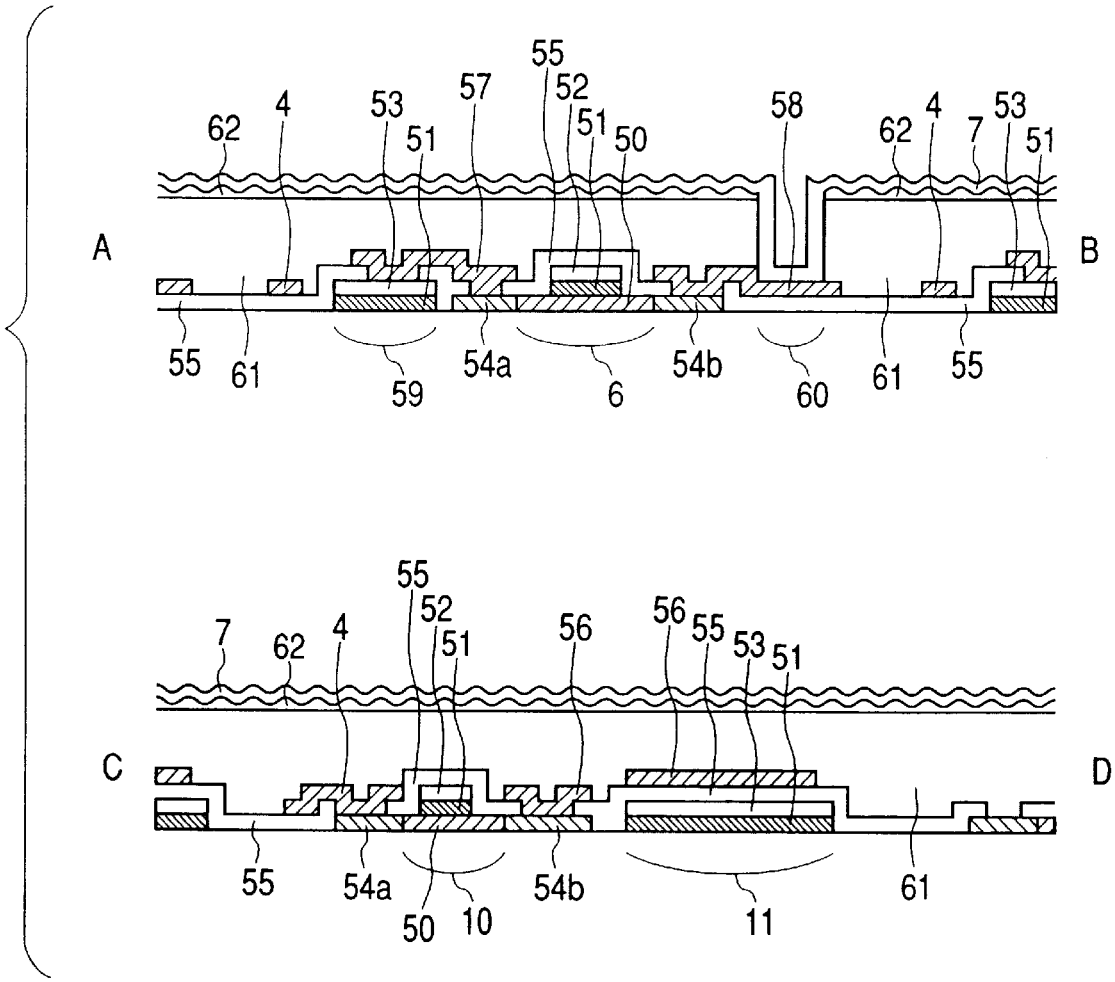
FIG. 4 is a cross sectional view of the pixel given in FIG. 3.

The mask pattern of the pixel shown in FIG. 2 is given in FIG. 3, and cross sectional views of A–B and C–D in FIG. 3 are illustrated in FIG. 4. The following describes the overview of the process forming this TFT substrate:

The amorphous silicon layer is first formed according to the LPCVD method, and is then polycrystallized by laser annealing; then island-formed silicons 50 of the switching TFT 6 and sampling TFT 10 are formed by patterning. Then silicon dioxide layer is formed as gate insulation layer 51 by APCVD method, and the metallic layer is then formed by LPCVD method. After that, two layers of the metallic layer and gate insulation film 51 are patterned by dry etching method, and a gate electrode 52 and bottom electrode 53 of sampling capacity are formed.

Then dopant such as phosphorus ion is implanted into the source and drain areas of the island-formed silicon by ion implantation. This is followed by heat treatment to provide activation for conversion into low resistant n-type silicon, thereby forming a drain electrode 54*a* and source electrode 54*b*. After formation of a silicon dioxide layer as a TFT protection layer 55, the first contact hole is formed. After formation of a metallic layer such as Cr, patterning is provided to form signal electrode 4, top electrode 56 of sampling capacity, connection unit 57, and connection unit 58. Via said contact hole, signal electrode 4 is connected to the drain electrode 54*a* of the sampling TFT 10, the top electrode 56 of the sampling capacity to the source electrode 54*b* of the sampling TFT 10, connection unit 57 to the bottom electrode 53 of the sampling capacity and the drain electrode 54*a* of the switching TFT 6, and connection unit 58 to the source electrode 54*b* of the switching TFT 6, respectively.

Furthermore, a second contact hole is formed after an insulation layer 61 is formed using the photosensitive organic film or the like. Similarly, after patterning the photosensitive organic film or the like on the insulation layer 61 by photolithography, irregular shaped layer 62 with smooth irregularities formed on the surface is formed by heating, and a metallic layer having a high reflection factor is formed thereon. Then display electrode 7 is formed by patterning. The process of TFT substrate formation is now complete.

This production process is a low temperature p-Si TFT process. The high temperature p-Si TFT process may be used to get a TFT having excellent mobility and to reduce the TFT size. This has an advantage of providing an easier way of building the peripheral scanning line selection circuit or the like into TFT. In all of the mask patterns shown in FIG. 3, the sampling TFT 10 and switching TFT 6 have a coplanar structure. The sampling capacitor 11 is formed via the TFT protection layer 55 between the top electrode 56 formed by using the same layer as signal electrode 4 and the bottom electrode 53 formed by using the metallic layer of common electrode 8.

FIG. 3 shows the configuration where no other component is present between adjacent display electrodes 7. If TFT is formed on the glass substrate, it is transparent between display electrodes; therefore, light reflected on this portion will not be reflected. This portion has no display electrode, so a desired voltage is not applied. Therefore, if there is any component reflecting light it will result in increase of unwanted reflected light component, thereby reducing contrast. However, unwanted reflection will be eliminated by layout of the display electrode as shown in FIG. 3, thereby allowing a high contrast ratio to be ensured.

Figure 5:
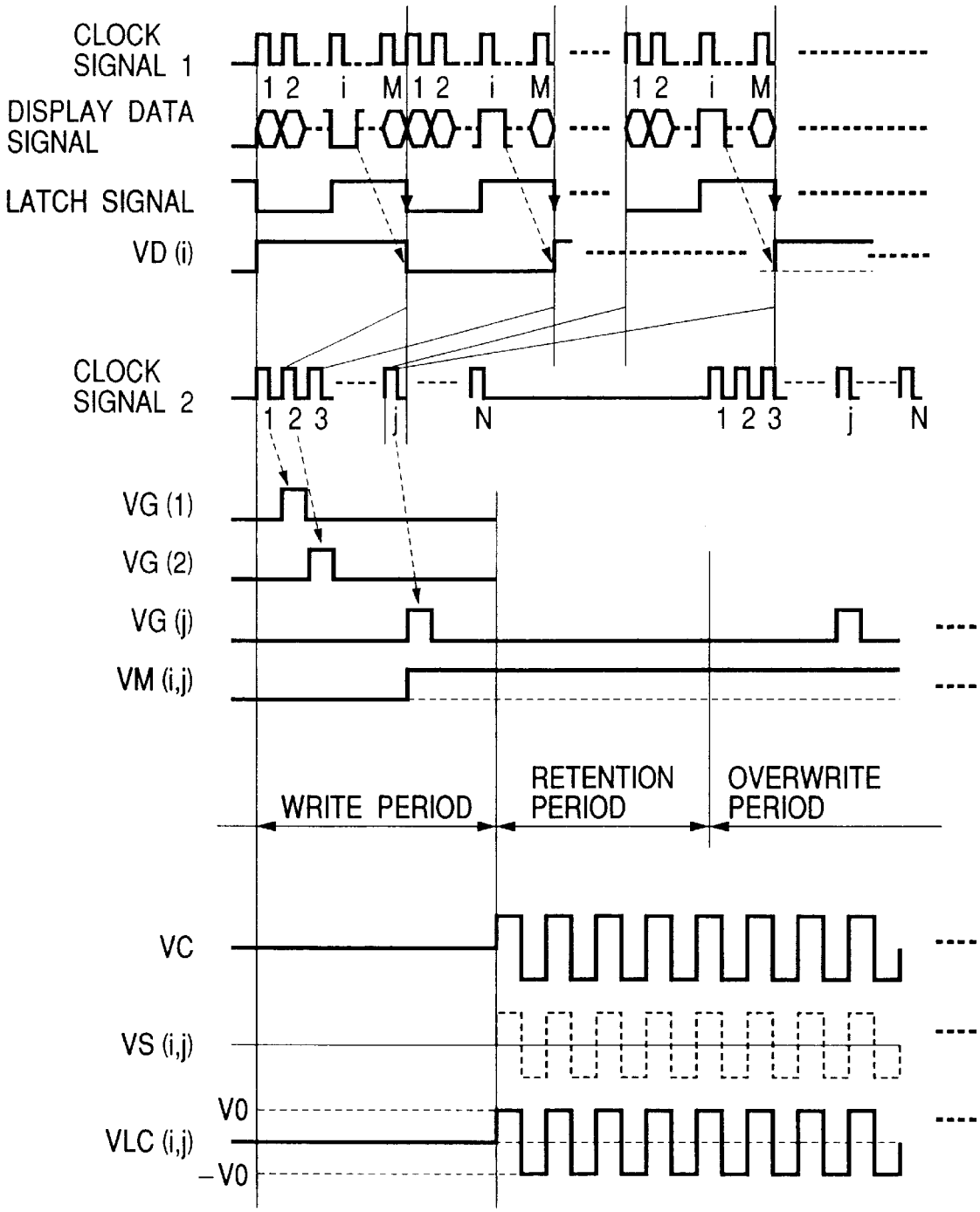
FIG. 5 represents the drive waveform according to the present invention of the first Embodiment.
Figure 6:
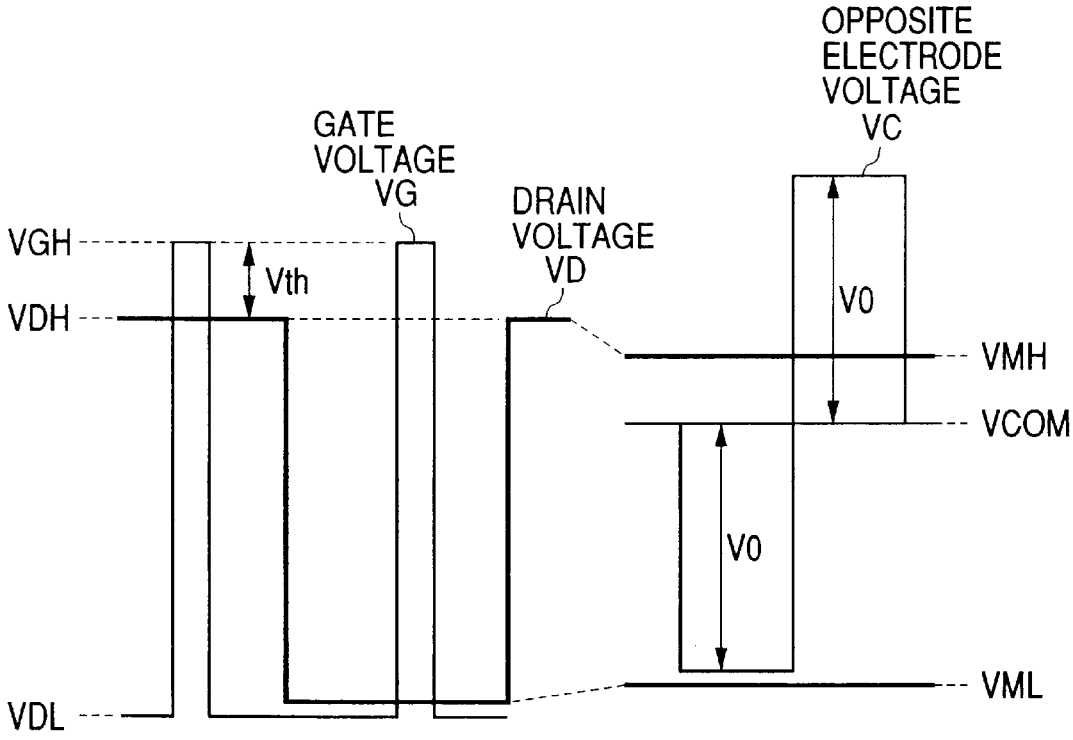
FIG. 6 shows the voltage level of the drive waveform given in FIG. 5.

The following describes the operation principle of the first Embodiment of the liquid crystal display by the present invention comprising N-row×M-column pixels, using the drive waveform shown in FIG. 5 and voltage level shown in FIG. 6. Here the display data signal voltage to write i-column by j-row pixels into the sampling capacitor of pixel (i, j) and pixel (i, j) is defined as V (i, j), where V (i, j) denotes either voltage level VDH or VDL shown in FIG. 6.

The liquid crystal display is driven by three periods; write period, retention period and overwrite period. When display has switched, it is driven in the order of write period, retention period, overwrite period, retention period, overwrite period, etc. If display does not change, it is driven in the order of retention period and overwrite period repeatedly. Write period are used only when display has been switched.

During the write period, the voltage VC of the opposite electrode is made equal to the voltage VCOM of the common electrode. Therefore, the voltage VS of the display electrode 7 will be VS=VC=VCOM, so voltage is not applied to the liquid crystal (VC−VCOM=VLC=0).

Signals which select the signal electrode 4 sequentially are issued from the shift register in response to clock signal 1. The display data signal is synchronized with the clock signal 1. Display data signals V (i, j) are produced when the signal electrode in the i-th column is selected. Accordingly, display data signal V (i, j) is captured into the data latch circuit corresponding to specified signal electrode by the display data signal sampling TFT 101. After display data signals corresponding to the M signal electrodes have been captured, display data signal VD (i)=V (i, j) (i=1 through N) are output simultaneously to all signal electrodes synchronously with latch signal. VD (i')=V (i', j)=VDH is issued to the signal electrode connected to the pixel (i', j) where display is on, while VD(i")=V(i", j)=VDL is issued to the signal electrode connected to the pixel (i", j) where display is off. In this case, the scanning line selection circuit selects the corresponding scanning electrode to produce the VG (j)=VGH, concurrently as display data signals are issued from the latch circuit in response to clock signal 2. (Voltages of other scanning electrodes are VGL). Namely, voltage not less than the threshold value Vth of the sampling capacitor is applied to the scanning electrode. The sampling TFT 10 of pixel (i, j) where the voltage VG(j) of the connected scanning electrode has become VGH captures voltage VD (i) of the connected signal electrode 4, and stores voltage VD(i)=V (i,j) in the sampling capacitor 11. The above operations are repeated N times equivalent to the number of the scanning electrodes, and data of the display data retention circuit for all pixels are rewritten, thereby terminating the write period.

Then the operations of clock signal 1, display data signal, latch signal, and clock signal 2 are stopped (low level signals are issued), and a.c. voltage VC is applied to the opposite electrode (retention period). During this retention period, voltage VM retained in the sampling capacitor 11 is changed by the leakage of sampling TFT or the like. However, the length of the period is set to ensure that the voltage VDH written into the pixel where display is on is not less than voltage VMH required to turn on the switching TFT 6 throughout the retention period, and the voltage VDL written into the pixel where display is off does not exceed voltage VML required to turn off the switching TFT 6 throughout the retention period. Accordingly, during the retention period, the switching TFT 6 of the pixel where display is on is in the state of connection (ON state), while the switching TFT 6 of the pixel where display is off is in the state of non-connection (OFF state). So as shown in FIG. 5, the voltage VS (i, j) of the display electrode 7 of the pixel where display is on is equal to the voltage VCOM of the common electrode (solid line), whereas the voltage VS (i, j) of the display electrode 9 of the pixel where display is off is equal to the voltage VC of the opposite electrode 9 (broken line). Since voltage VLC (i, j)=VC−VS (i, j) is applied to the liquid crystal, a.c. voltage with amplitude V0 is applied to the liquid crystal of the pixel where display is on (solid line), while voltage is not applied to the liquid crystal of the pixel where display is off (broken line).

In the ensuing overwrite period, voltage changed due to leakage and stored in the sampling capacitor 10 is written again. In this case, since display does not change, a.c. voltage is applied to the opposite electrode, as in the case of retention period. In other words, the operation is the same as that in the write period, except that VC is a.c. voltage. Similarly to the write period, voltage synchronous with scanning electrode voltage from the latch circuit is issued to the signal electrode, and is captured by the corresponding sampling TFT 10 to be stored in the sampling capacitor 11. In this case, voltage stored in the sampling capacitor 11 changes from VMH to VDH or from VML to VDL in response to display. This change does not affect the state of switching capacitor 6, so the voltage applied to the liquid crystal does not change. In other words, the display is not affected.

According to the prior art, display data signal voltage written into the pixel via the signal electrode is written into the display electrode, and is applied directly to the liquid crystal. According to the present invention, voltage to control display state is applied to the sampling capacitor, unlike the prior art. After having been written into the sampling capacitor, the stored display data signal voltage is changed gradually by leakage of the sampling TFT during the period before the scanning electrode is selected again in the overwrite period. However, display quality does not change until change is made in excess of the threshold value voltage of the switching TFT. This makes it possible to provide a sufficiently long retention period.

Figure 7:
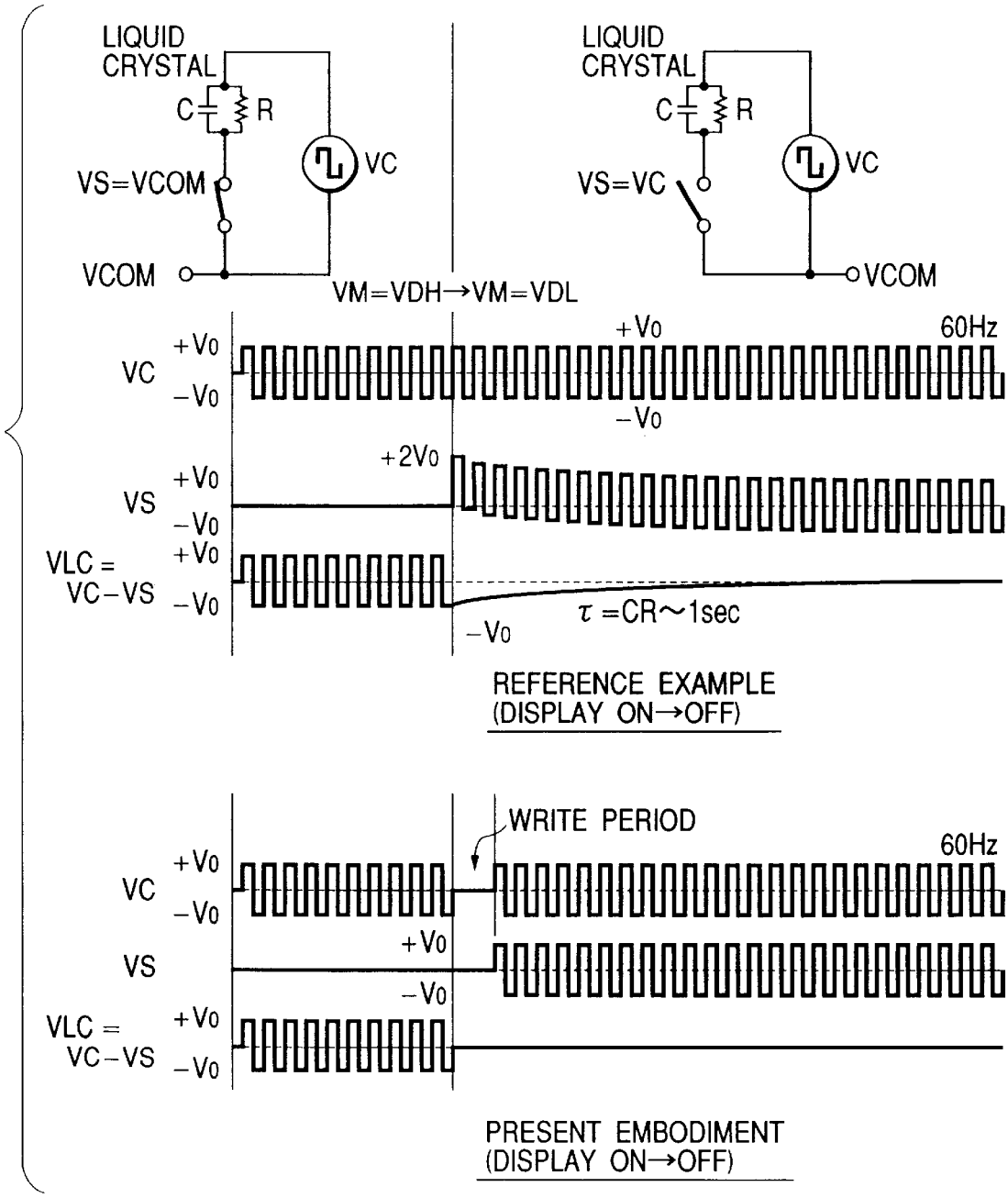
FIG. 7 depicts voltage waveforms of the Embodiment and Reference Example according to the present invention.

According to the present Embodiment, the voltage VC of the opposite electrode is made equal to voltage VCOM of the common electrode during the write period as described above, so that voltage is not applied to the liquid crystal. This arrangement permits immediately switching of display. FIG. 7 in a Reference Example shows the waveform of the voltage applied to the liquid crystal when display is switched with a.c. voltage applied to the opposite electrode VC, and voltage waveform according to the present Embodiment. It shows a voltage waveform when voltage VM stored in the sampling capacitor 11 has switched from VDH to VDL, namely, display has switched from ON to OFF.

The case of Reference Example corresponds to the state where the switch is opened when a.c. voltage VC is applied to the liquid crystal, as shown in the equivalent circuit in FIG. 7.

In this Figure, VC changes by 2V from −V0 to +V0 immediately after the switch is opened. In this case, the circuit is released, so voltage applied to the liquid crystal is retained (VLC=VC−VS=−V0). Namely, the voltage VS of display electrode 7 is VS=VC+VO=2V0. This d.c. voltage is damped by the time constant $\epsilon\rho$ determined by the dielectric constant $\epsilon$ of the liquid crystal and resistivity $\rho$. The dielectric constant of normal liquid crystal material is approximately $\rho=10\times\epsilon 0$ ($\epsilon 0=8.854\times10^{-12}$ F/m, dielectric constant of free space). The resistivity is approximately $\rho=10^{12}$ Ωcm, with time constant of about 0.8854 sec. In other words, about one second is required for switching of display. By contrast, the present invention allows display to be switched immediately after write period. Normally, all pixels are rewritten in 1 frame period (16.6 ms) or less, so the image is switched almost instantly according to the prior art method.

As described above, use of the present Embodiment provides a liquid crystal display featuring lower power consumption and high speed display switching.

In the present Embodiment, voltage VC of the opposite electrode and voltage VS of the display electrode are made equal the voltage VCOM of the common electrode when display is changed from ON to OFF. Here it is sufficient that these three voltages are virtually the same; it is sufficient that voltage equal to or greater than the threshold value is not applied to the liquid crystal layer. This holds good for the following Embodiments.

Use of the first Embodiment allows makes write period as short as 16.6 ms when the number of pixels is 640 by 480 dots, where display is switched almost instantly. However, increase in the number of pixels prolongs write period, and display switching is felt to be slow. For example, to get a 4000×4000-dot high definition display, it will take about 16.6 ms×(4000×4000)/(640×480)=0.9 sec. This means that the write period is very long; one second will be required until the new screen appears. If clock signal frequency is made higher, the write period will be shortened. However, power consumption will increase in proportion to the clock signal frequency. Thus, this is not fitted to implement a lower power consumption and high speed screen switching function.

Embodiment 2

Figure 8:
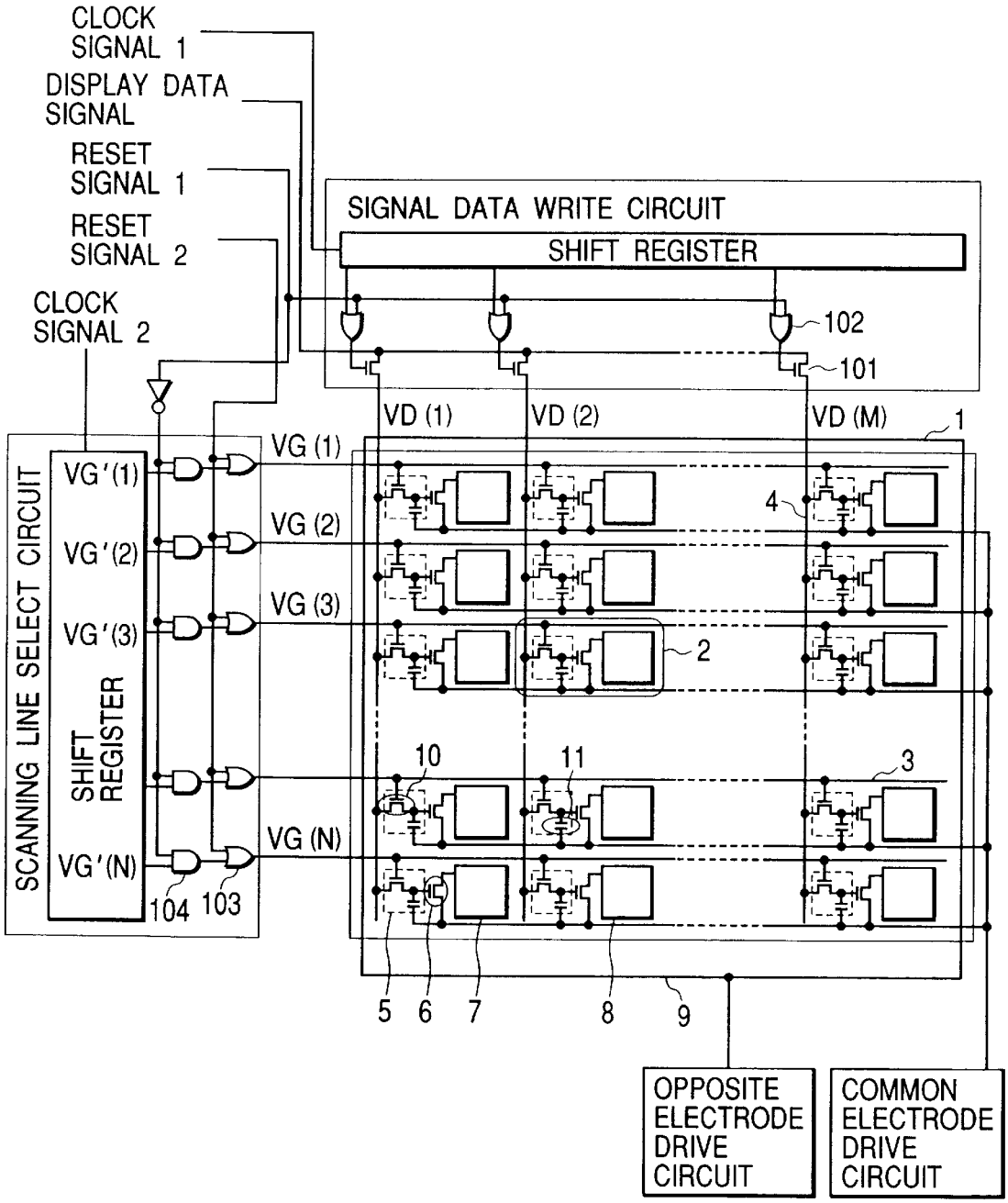
FIG. 8 is a block diagram representing the configuration of the second Embodiment according to the present invention.

The second Embodiment described below enables high speed display of a new screen at a lower power consumption rate even when there is an increase in the number of pixels. FIG. 8 is a block diagram of the second Embodiment of a liquid crystal display according to the present invention.

The configuration of display unit 1 is the same as the first Embodiment. The signal data write circuit comprises a shift register to produce output in response to clock signal 1, an OR circuit 102 to issue the output of the shift register and OR signal of reset signal 1, and a display data sampling TFT 101 to sample display data signal in response to the output of OR circuit 102 and to issue it to the signal electrode. The scanning line selection circuit comprises a shift register to produce output in response to clock signal 2, an AND circuit 104 to issue the AND signal between the output of the shift register and inversion signal of the reset signal 1 and an OR circuit 103 to issue the output of AND circuit 104 and OR signal of the reset signal 1.

Common electrodes 8 are arranged in common for each row in parallel with scanning electrodes 3, and are connected with one another for connection of all pixels in common. Voltage VCOM is applied by the common electrode drive circuit. From the opposite electrode drive circuit, voltage VC is applied to opposite electrode 9 on the opposite substrate installed opposite to a display electrode 7 on the TFT substrate holding the liquid crystal in-between. Although not illustrated except for the opposite substrate, a phase plate and polarizing plate are arranged to constitute a reflective type liquid crystal display. In the present Embodiment, a quarter wave plate is used as a phase plate to ensure that black is displayed while voltage is applied to the liquid crystal, and white is displayed when not applied. Setting is made so that the optical axis of the phase plate and the absorption plate of the polarizing plate have an angle of 45 degrees.

Figure 9:
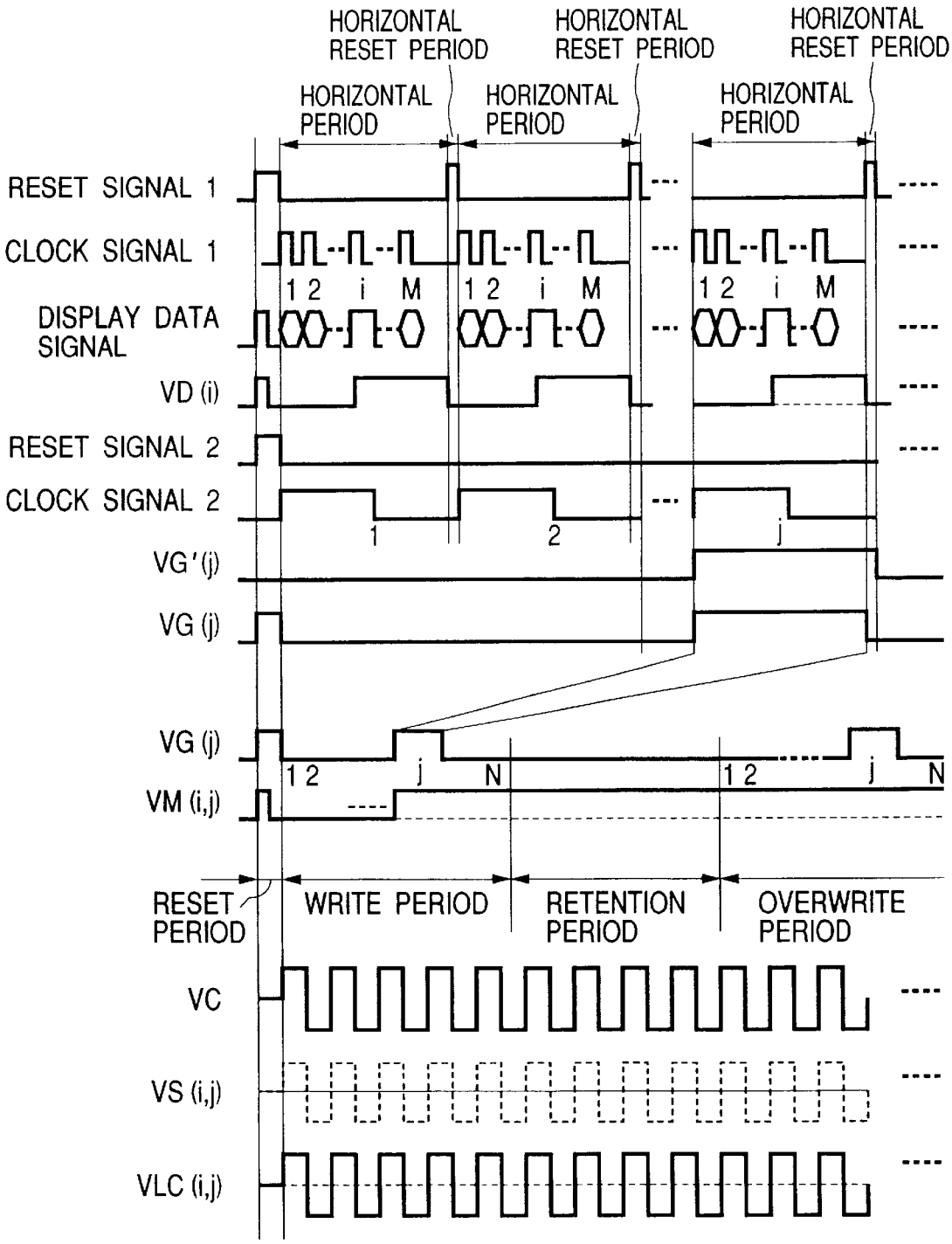
FIG. 9 represents the drive waveform according to the present invention of the second Embodiment.

The following describes the operation principle of a second Embodiment of the liquid crystal display comprising N-row by M-column pixels according to the present invention using a drive waveform shown in FIG. 9. Display data signal voltage to write the i-column by j-row pixel into the sampling capacitor of pixel (i, j) and pixel (i, j) is defined as V (i, j), where V (i, j) is either voltage level VDH or VDL shown in FIG. 6.

The liquid crystal display is driven by four periods; reset period, write period, retention period, and overwrite period. When the display has been switched, it is driven in the order of reset period, write period, retention period, and overwrite period, retention period, overwrite period, etc. If display does not change, it is driven in the order of retention period and overwrite period repeatedly. Reset period and write period are used only when display has been switched.

Reset signal 1 and reset signal 2 go high during the reset period. In this case, the outputs of the OR circuit 102 and OR circuit 103 go high despite the state of the shift register, etc. Since the output of OR circuit 102 is of high level, the display data signal is written into all signal electrodes through display data sampling TFT 101. Since the output of OR circuit 103 is at the high level, voltage of all scanning electrode is VG(j)=VGH, and the display data signals of the signal electrodes are written into the sampling capacitor of all the pixels. The display data signal becomes VDL after having become VDH once during the reset period. So the switching TFTs of all pixels are turned off after having been turned on once. During the reset period, voltage VC of the opposite electrode is equal to voltage VCOM of the common electrode, so display electrode 7 is kept in the floating mode after voltage has become VCOM, thereby retaining voltage VCOM.

In the ensuing write period, voltage V(i, j) in response to display is written into the sampling capacitor of pixel (i ,j) while a.c. voltage is applied to the opposite electrode, unlike in the first Embodiment. In this case, the switching TFT is set to off in the reset period, so there is no change to the OFF state from the ON state where the d.c. voltage is applied to the liquid crystal as explained with reference to FIG. 7.

Signals to select the signal electrode sequentially are output from the shift register in response to clock signal 1. Display data signal is synchronized with clock signal 1, and corresponding display data signal V (i, j) is output when the specified signal electrode is selected. Consequently, display data signal VD (i) (i=1 through N) is sequentially issued to the specified signal electrode by the display data signal sampling TFT 101. VD(i')=VDH is issued to the signal electrode connected to the pixel (i', j) where display is on, while VD(i")=VDL is output to the signal electrode connected to the pixel (i", j) where display is off. (See FIG. 6).

After above operations have been repeated M times, clock signal 1 stops and VD (i) is retained at the M signal electrodes for a specified time. After that, the reset signal 1 goes high, and display data signals are written into all signal electrodes through the display data signal sampling TFT 101.

(This period is defined as a horizontal reset period). In this case, display data signals are at the low level (VDL), and VDL is written into all signal electrodes. This period is defined as a horizontal period.

If there is no horizontal reset period in this case, voltage V (i, J-i) written during (j−1)-th horizontal period will remain in the signal electrode, when voltage of the j-th scanning electrode becomes VGH in the j-th horizontal period. As a result, an operation error may occur in the case of V (i, j)≠V(i, j−1). For example, when V (i, j−1)=VDH and V (i ,j)=VDL, the switching TFT 6 of the pixel (i, j) is turned on, since the voltage of the gate becomes V (i, j−1)=VDH through sampling TFT 10 immediately when the voltage of j-th scanning electrode has become VGH. However, the original display data signal V (i, j)=VDL is written during the j-th horizontal period, so the switching TFT is turned off. In this way, the switching TFT changes from ON state to OFF state when a.c. voltage is applied to the opposite electrode. This leads to an operation error where d.c. voltage is applied to the liquid crystal (called operation error caused by the preceding row), as described above. To solve this problem, the present Embodiment makes the voltage of all signal electrodes VGL at the close of the horizontal period of the horizontal reset period, thereby preventing said operation error. Similarly to the first Embodiment, no operation error can possibly be caused by said data in the preceding row even if a latch circuit is installed in the signal data write circuit. Use of the present Embodiment avoids operation errors resulting from said data of the preceding row in a small circuit, without having to employ a latch circuit.

If the shift register output VG' (j) is directly applied to the scanning electrode when display data signal is written into the sampling capacitor 11 of the j-th row pixel in the j-th horizontal period of the write period, then display data signals v (i, j) written during the horizontal reset period will be rewritten and VGL will be written into all the sampling capacitors of the j-th row pixel. To solve this problem, the present Embodiment applies voltage the scanning electrode in the following manner: During the horizontal period, the shift register of the scanning line selection circuit selects the scanning electrode in response to clock signal 2 in the horizontal period, so high level output is issued to the VG' (j) in order to select the scanning electrode. The inversion level of the reset signal 1 and the AND signal of the VG' (j) are output to the scanning electrode So in the horizontal period, VG (j)=VGH is output only during the period where the reset signal is of low level. The sampling TFT of the pixel (i, j) where voltage VG (j) of the connected scanning electrode has become VGH captures the voltage VD (i) of the connected signal electrode, and the voltage is retained at the sampling capacitor. Since VG (j)=VGL in the ensuring horizontal reset period, the connected sampling TFT turns off, and VD (i) in response to display is retained, without voltage VDL of the signal electrode during the horizontal reset period being written to the sampling capacitor 11. The above horizontal period is repeated N times which correspond to the number of the scanning electrodes, and the data of display data retention circuit of all pixels are rewritten, thereby terminating the write period.

In the write period of the second Embodiment, a.c. voltage is applied to the opposite electrode. So before termination of the write period, display is given sequentially, starting from the pixel where display data signal voltage V(i, j) is written into the sampling capacitor. This ensures faster display than that in the first Embodiment when display has switched.

Then the operations of clock signal 1, display data signal, clock signal 2, reset signal 1 and reset signal 2 are stopped, and a.c. voltage VC continues to be applied to the opposite electrode (retention period). Voltage VM retained in the sampling capacitor during this retention period varies according to the leakage of the sampling TFT and others. The length of the retention period is set to ensure that voltage VDH written into the pixel when display is on is equal to or greater than the VMH throughout retention period, while voltage VDL written into the pixel when display is off is equal to or greater than the VMH does not exceed VML throughout the retention period. Accordingly, during the retention period, the switching TFT of the pixel where display is on is in the state of connection (ON state), while the switching TFT of the pixel where display is off is in the state of non-connection (OFF state). So as shown in FIG. 9, the voltage VS of the display electrode of the pixel where display is on is equal to the voltage VCOM of the common electrode (solid line), whereas the voltage VS of the display electrode of the pixel where display is off is equal to the voltage VC of the opposite electrode (broken line). Since voltage VLC=VC−VS is applied to the liquid crystal, a.c. voltage with amplitude V0 is applied to the liquid crystal of the pixel where display is on (solid line), while voltage is not applied to the liquid crystal of the pixel where display is off (broken line).

The operation in the ensuing overwrite period is the same as that in the write period. Unlike the write period, an operation error occurs in the overwrite period, but this covers only a very short time without affecting the display. In the overwrite period when display data signal V (i, j)=VDH is overwritten into the sampling capacitor of the j-th pixel during the j-th horizontal period, voltage VGL written into the (j−1)-th horizontal reset period remains in the signal electrode when the voltage of the j-th scanning electrode becomes VG(j)=VGH. Since voltage of VMH or more is retained to the sampling capacitor before the overwrite period, the switching TFT changes from ON to OFF state when a.c. voltage is applied to the opposite electrode immediately when the voltage of the j-th scanning electrode has become VGH. This allows d.c. voltage to be applied to the liquid crystal as described above. In this case, however, V (i, j)=VDH is written immediately thereafter, and the switching TFT is turned on. So d.c. voltage is applied to the liquid crystal only for a very short time, without affecting the display.

In the present Embodiment, this voltage is retained for a specified time period after VD (i) has been issued to all signal electrodes during the horizontal period of the write period and overwrite period; then the voltage of the scanning electrode is made VGL, and reset signal 1 is set to the high level. The operation is also possible if the scanning electrode voltage is made VGL and reset signal 1 is set to the high level, immediately after all signal electrodes VD (i) are output. In this case, however, the period where specified voltage VD(M)=V(M, j) is applied to the M-th signal electrode will be very short. So to write VD(M) into the sampling capacitor 11, the sampling TFT is required to have a very high performance. The operation is possible when a low performance TFT is used if the scanning electrode voltage is kept at VGH for some time even after the specified voltage VD(M)=V(M, j) is applied to the M-th signal electrode, and a longer time is assigned to write into the sampling capacitor, as in the present Embodiment.

As described above, the present Embodiment provides a liquid crystal display characterized by high definition, lower power consumption, and a high speed display when display has switched.

Embodiment 3

Figure 10:
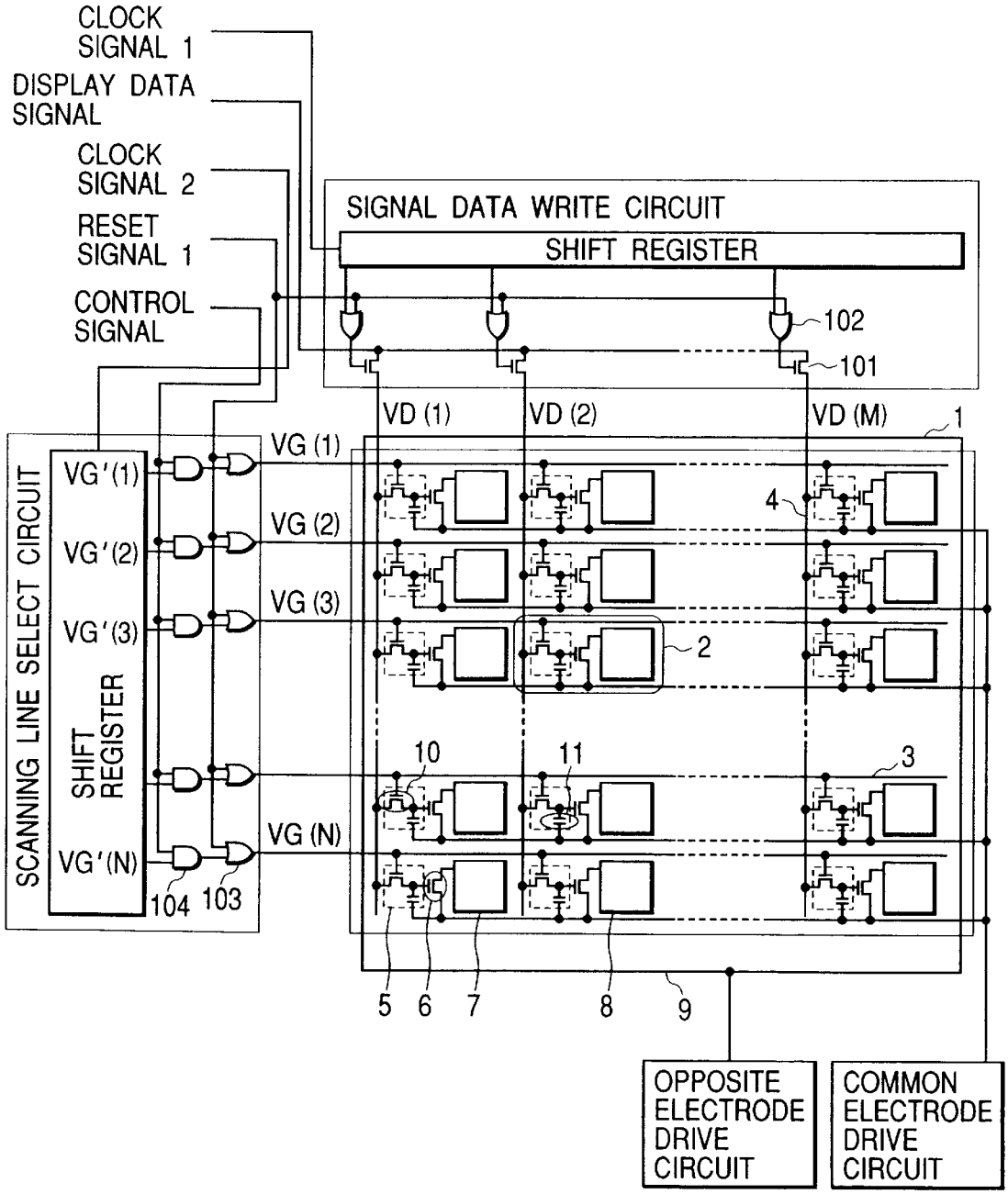
FIG. 10 is a block diagram representing the configuration of the third Embodiment according to the present invention.

The operation error caused by data in the preceding row can also be solved by a third Embodiment according to the present invention to be described below. FIG. 10 is a block diagram of the third Embodiment of the liquid crystal display according to the present invention.

Display unit 1 is arranged in the same configuration as that of the first Embodiment. The signal data write circuit is arranged in the same configuration as that of the second Embodiment. The scanning line selection circuit comprises (1) a shift register to produce outputs in response to clock signal 2, (2) an AND circuit 104 to issue AND signals between the output of said shift register and control signal, and (3) an OR circuit 103 to issue OR signals between the output of said AND circuit 104 and reset signal 1.

Common electrodes 8 are arranged in common for each row in parallel with scanning electrodes 3, and are connected with one another for connection of all pixels in common. Voltage VCOM is applied by the common electrode drive circuit. From the opposite electrode drive circuit, voltage VC is applied to opposite electrode 9 on the opposite substrate installed opposite to a display electrode 7 on the TFT substrate holding the liquid crystal in-between. Although not illustrated except for the opposite substrate, a phase plate and polarizing plate are arranged to constitute a reflector type liquid crystal display. In the present Embodiment, a quarter wave plate is used as a phase plate to ensure that black is displayed while voltage is applied to the liquid crystal, and white is displayed when not applied. Setting is made so that the optical axis of the phase plate and the absorption plate of the polarizing plate have an angle of 45 degrees.

Figure 11:
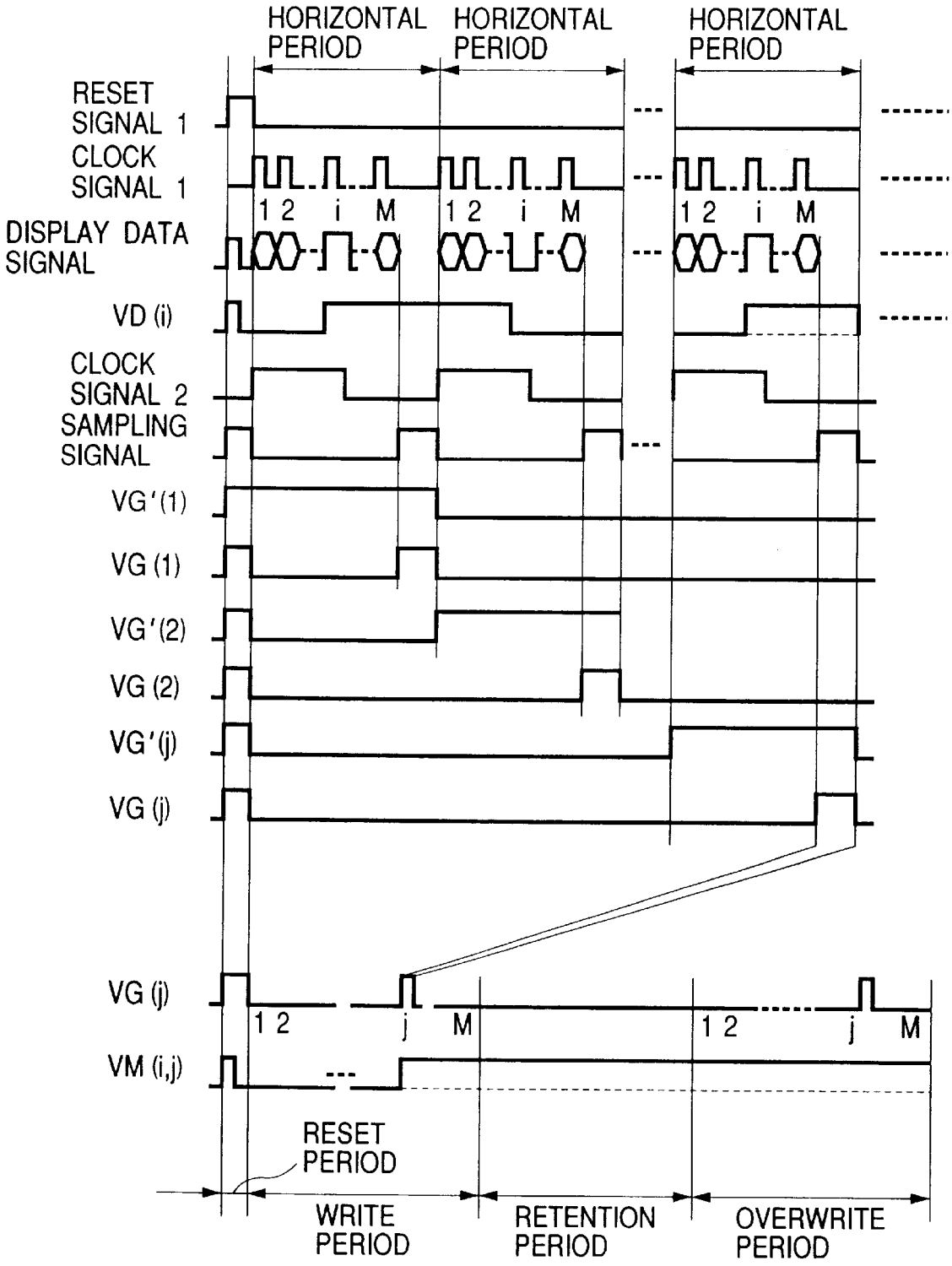
FIG. 11 represents the drive waveform according to the present invention of the third Embodiment.

The following describes the operation principle using the drive waveform shown in FIG. 11. Here the display data signal voltage to write i-column by j-row pixels into the sampling capacitor of pixel (i, j) and pixel (i, j) is defined as V (i, j), where V (i, j) denotes either voltage level VDH or VDL shown in FIG. 6.

The liquid crystal display is driven by four periods; reset period, write period, retention period, and overwrite period. The operations in reset period and retention period are the same as those in the second Embodiment.

In the write period, voltage v (i, j) in response to display is written into the sampling capacitor of the pixel (i, j) while a.c. voltage is applied to the opposite electrode, unlike the case in the first Embodiment. In this case, the switching TFT is off in the reset period, so there is no change to the OFF state from the ON state where the d.c. voltage is applied to the liquid crystal.

Similarly to the case of the second Embodiment, operation errors resulting from said data of the preceding row are avoided without using a latch circuit.

Signals to selects scanning electrodes sequentially in response to clock signal 1 are issued from the shift register. Display data signals are synchronized with clock signal 1, and a corresponding display data signal V (i, j) is output when a specified signal electrode is selected. Consequently, display data signals VD(i) (i=1 through N) are sequentially output to the specified signal electrode by the display data signal sampling TFT 101. VD(i')=VDH is issued to the signal electrode connected to the pixel (i', j) where display is on, while VD(i")=VDL is output to the signal electrode connected to the pixel (i", j) where display is off. (See FIG. 6). After above operations have been repeated M times, clock signal 1 stops and VD (i) is retained at the M signal electrodes for a specified time. This period is defined as a horizontal period.

In the horizontal period, the shift register of the scanning line selection circuit issues a high level to VG' (j) in response to clock signal 2 synchronized with horizontal period to select the scanning electrode. The AND signal between control signal and VG (j) is issued to the scanning electrode, so VG (j)=VGH is output for the period where the control signal is high, namely only for the specified period where said VD (i) is retained. The sampling TFT of the pixel (i, j) where voltage VG (j) of the connected scanning electrode has become VGH captures the voltage VD (i) of the connected signal electrode, and the voltage is retained at the sampling capacitor.

The above horizontal period is repeated N times which correspond to the number of the scanning electrodes, and the data of display data retention circuit of all pixels are rewritten, thereby terminating the write period.

In the write period, voltages of all signal electrodes become VGH after the voltage of the j-th scanning electrode has become VD (i)=VD(i, j), so voltage written into the (j−1)-th horizontal period does not affect the j-row pixel.

Operations in the overwrite period are the same as those in the write period. Display data signal in the preceding row does not give any influence. The present Embodiment also provides a liquid crystal display characterized by high definition, lower power consumption, and a high speed display when display has switched.

By using a latch circuit, OR circuit or AND circuit in the signal write circuit and scanning line selection circuit in the Embodiment described above, it is possible to provide a liquid crystal display characterized by high definition, lower power consumption, and a high speed display when display has switched.

Embodiment 4

The fourth Embodiment provides a liquid crystal display which permits the same operations as above Embodiments, using a small-sized signal data write circuit and a scanning line selection circuit without using a latch circuit, OR circuit or AND circuit. The small size of the signal data write circuit and scanning line selection circuit effectively increases the yield when manufacturing these circuits the TFT substrate using a polysilicon TFT or the like.

Figure 12:
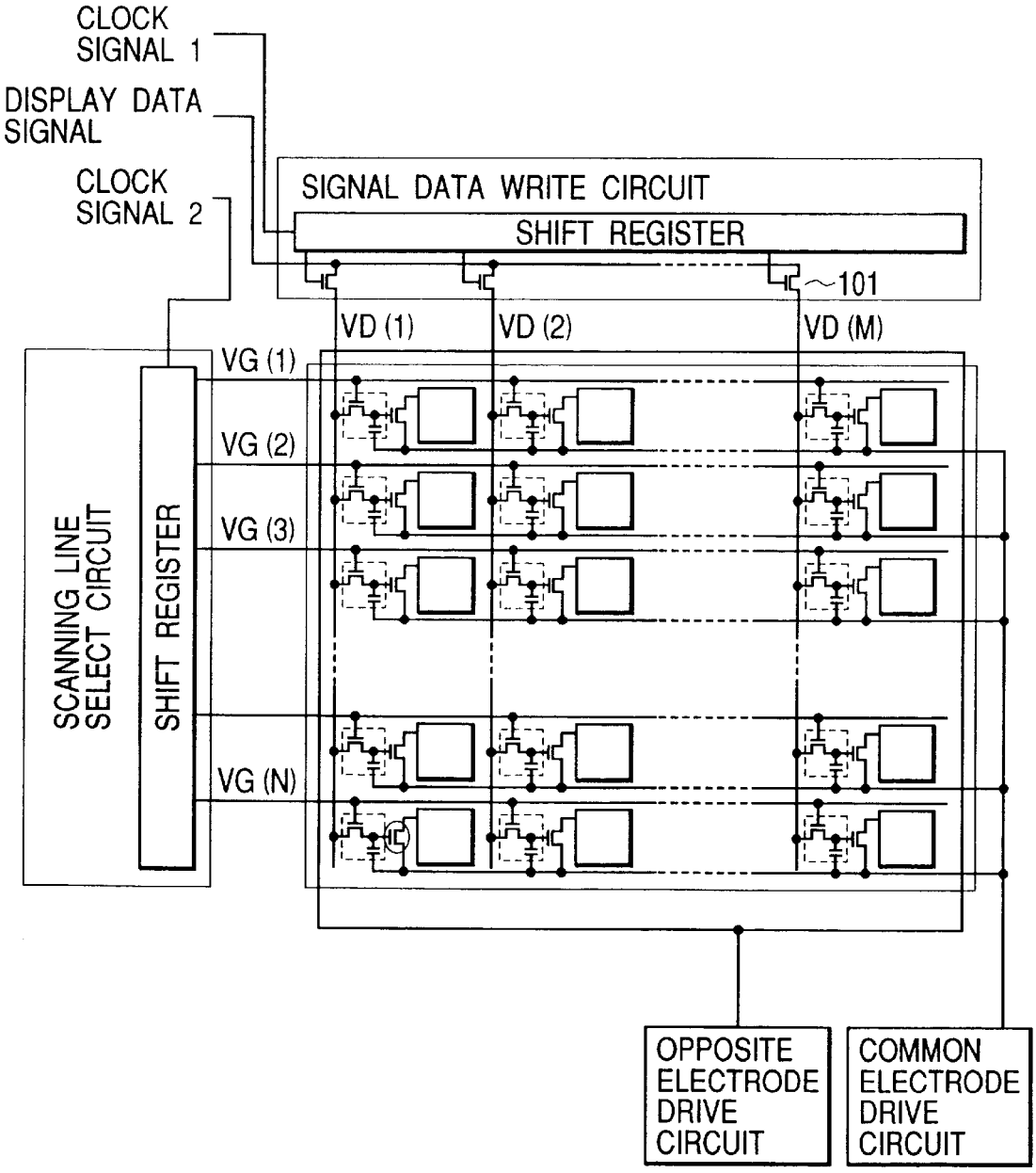
FIG. 12 is a block diagram representing the configuration of the fourth Embodiment according to the present invention.

FIG. 12 is a block diagram representing the fourth Embodiment of a liquid crystal display according to the present invention. Display unit 1 formed on the TFT substrate is the same as that of the first Embodiment. The signal data write circuit comprises a shift register to issue outputs in response to clock signal 1, and a display data signal sampling TFT 101 to sample display data signals in response to the output of the shift register. The scanning line selection circuit comprises a shift register which issues VG(j)=VGH to the scanning electrode in response to clock signal 2.

Common electrodes 8 are arranged in common for each row in parallel with scanning electrodes 3, and are connected with one another for connection of all pixels in common. Voltage VCOM is applied by the common electrode drive circuit. From the opposite electrode drive circuit, voltage VC is applied to opposite electrode 9 on the opposite substrate installed opposite to a display electrode 7 on the TFT substrate holding the liquid crystal in-between. Although not illustrated except for the opposite substrate, a phase plate and polarizing plate are arranged to constitute a reflector type liquid crystal display. In the present Embodiment, a quarter wave plate is used as a phase plate to ensure that black is displayed while voltage is applied to the liquid crystal, and white is displayed when not applied. Setting is made so that the optical axis of the phase plate and the absorption plate of the polarizing plate have an angle of 45 degrees.

Figure 13:
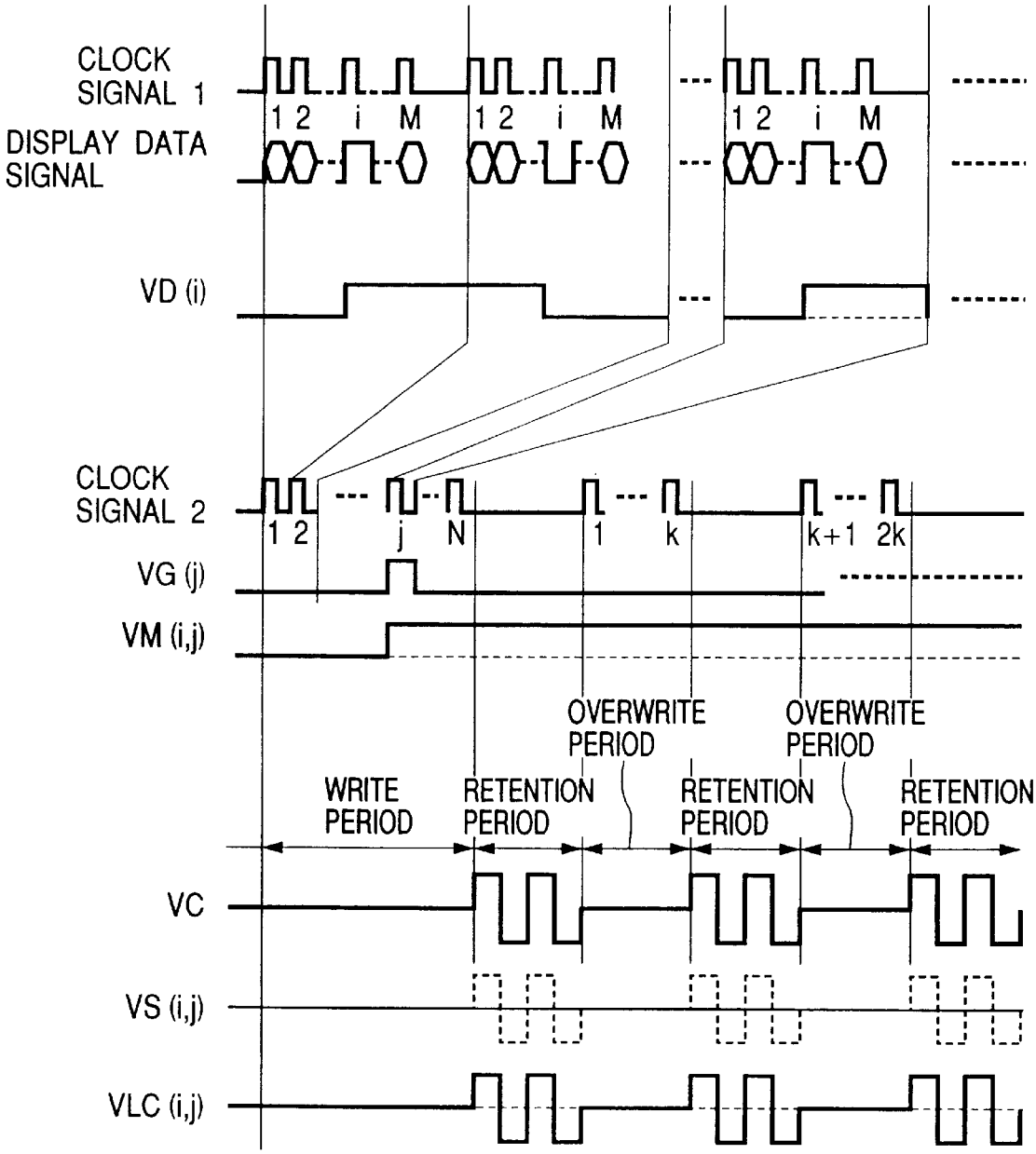
FIG. 13 represents the drive waveform according to the present invention of the fourth Embodiment.

The following describes the operation principle of the fourth Embodiment of the liquid crystal display according to the present invention comprising N-row×M-column pixels, using the drive waveform shown in FIG. 13. Here the display data signal voltage to write i-column by j-row pixels into the sampling capacitor of pixel (i, j) and pixel (i, j) is defined as V (i, j), where V (i, j) denotes either voltage level VDH or VDL shown in FIG. 6.

The liquid crystal display is driven by three periods; write period, retention period and overwrite period. When display has switched, it is driven in the order of write period, retention period, overwrite period, retention period, overwrite period, etc. If display does not change, it is driven in the order of retention period and overwrite period repeatedly. Write period is used only when display has been switched. During the write period and overwrite period, the voltage VC of the opposite electrode is made equal to the voltage VCOM of the common electrode. So no voltage is applied to the liquid crystal (VLC=0).

Signals which select the signal electrode sequentially are issued from the shift register in response to clock signal 1. The display data signal is synchronized with the clock signal 1. Display data signals V (i, j) are produced when the signal electrode in the i-th column is selected. Accordingly, display data signal v (i, j) is captured into the specified signal electrode by the display data signal sampling TFT. Display data signal VD(i)=V (i, j) (i=1 through N) is sequentially output. VD (i')=V (i', j)=VDH is issued to the signal electrode connected to the pixel (i', j) where display is on, while VD (i")=V (i", j)=VDL is output to the signal electrode connected to the pixel (i", j) where display is off. In this case, the scanning line selection circuit selects the scanning electrode in response to clock signal 2, and issues VG (j)=VGH. (The voltage of other scanning electrodes is VGL). In other words, voltage equal to or greater than the threshold value of the sampling capacitor is applied to the scanning electrode. The sampling TFT of the pixel (i, j) where voltage VG (j) of the connected scanning electrode has become VGH captures the voltage VD (i) of the connected signal electrode, and the voltage VD(i)=V(i,j) is retained at the sampling capacitor. This operation is repeated N times which correspond to the number of the scanning electrodes, and the data of display data retention circuit of all pixels are rewritten, thereby terminating the write period.

Then the operations of clock signal 1, display data signal and clock signal 2 are stopped, and a.c. voltage VC continues to be applied to the opposite electrode (retention period). Voltage VM retained in the sampling capacitor during this retention period varies according to the leakage of the sampling TFT and others. The length of the retention period is set to ensure that the voltage VDH written into the pixel where display is on is not less than voltage VMH required to turn on the switching TFT throughout the retention period, and the voltage VDL written into the pixel where display is off does not exceed voltage VML required to turn off the switching TFT throughout the retention period. Accordingly, during the retention period, the switching TFT of the pixel where display is on is in the state of connection (ON state), while the switching TFT of the pixel where display is off is in the state of non-connection (OFF state). So as shown in FIG. 13, the voltage VS (i, j) of the display electrode of the pixel where display is on is equal to the voltage VCOM of the common electrode (solid line), whereas the voltage VS of the display electrode of the pixel where display is off is equal to the voltage VC of the opposite electrode (broken line). Since voltage VLC (i, j)=VC−VS (i, j) is applied to the liquid crystal, a.c. voltage with amplitude V0 is applied to the liquid crystal of the pixel where display is on (solid line), while voltage is not applied to the liquid crystal of the pixel where display is off (broken line).

In the ensuing overwrite period, voltage changed due to leakage and stored in the sampling capacitor is written again. Unlike the cases in the first, second and third Embodiments, the opposite electrode voltage is made equal to the common electrode voltage. In other words, no voltage is applied to the liquid crystal. VD (i)=V (i, j) (i=1 through N) are sequentially output to the specified signal electrode. The scanning line selection circuit selects the scanning electrode in response to clock signal 2, and issues VG (j)=VGH. (The voltage of other scanning electrodes is VGL). In other words, voltage equal to or greater than the threshold value of the sampling capacitor is applied to the scanning electrode. The sampling TFT of the pixel (i, j) where voltage VG (j) of the connected scanning electrode has become VGH captures the voltage VD (i) of the connected signal electrode, and the voltage VD (i)=V (i, j) is retained at the sampling capacitor. In the write period, this operation is repeated N times which correspond to the number of the scanning electrodes, and V (i, j) is written into the sampling capacitors of all pixels, but in the overwrite period, the N electrodes are separated into several segments for this writing. In the first overwrite period, for example, clock signal 1 and clock signal 2 are stopped after overwriting into the sampling capacitors of pixels from 1st to k-th rows, and a retention period is provided. In the ensuing second overwrite period, overwriting is made to the sampling capacitors of the pixels from k+1st to 2*k*-th. Then the retention period and overwrite period are repeated, and sampling capacitors of all pixels are overwritten using the multiple overwrite period.

Said operation error of d.c. voltage applied to the liquid crystal or said operation error caused by data in the preceding row does not occur in the overwrite period since a.c. voltage is not applied to the liquid crystal.

A longer overwrite period means a longer time when voltage is not applied to the liquid crystal, and a flicker problem is caused by reduced contrast resulting from reduced effective voltage applied to the liquid crystal or intermittent voltage applied to the liquid crystal. There will be a slight reduction of effective voltage if the overwrite period is made sufficiently shorter than the retention period. Then reduced contract does not raise any problem. No flicker occurs if the overwrite period is set, for example, to about 1 ms which is sufficiently shorter than liquid crystal response time. To reduce the overwrite period, however, the number of rows to be rewritten in one overwrite period must be reduced. As a result, a very long time will be required from the first overwriting to the next overwriting, when viewed in terms of one pixel. This requires the leakage of the display data retention circuit to be reduced to a very small amount. In other words, this requires use of a sampling TFT featuring a high performance. To perform the equivalent operation with the sampling TFT used in the first Embodiment, the ratio between the retention period and overwrite period should be the same as that in the first Embodiment, as described below. For example, if operations in the first Embodiment are possible in the retention period of 100 ms and the overwrite period of 100 ms, the retention period is set at 1 ms and overwrite period at 1 ms in the present Embodiment. The voltage of the sampling capacitors of all pixels should be overwritten in 100 overwrite periods. This step allows one overwriting to be performed every 200 ms in any cases, when viewed in terms of one pixel. This enables the operation using the sampling TFT of the same performance.

In the present Embodiment, a.c. voltage is not applied to the liquid crystal in the overwrite period, so effective voltage is reduced to a half. However, the same display is enabled by doubling the amplitude of the a.c. voltage applied to the opposite electrode.

The present Embodiment provides a liquid crystal display using a small-sized circuit characterized by lower power consumption, and a high speed display when display has switched.

Embodiment 5

Figure 14:
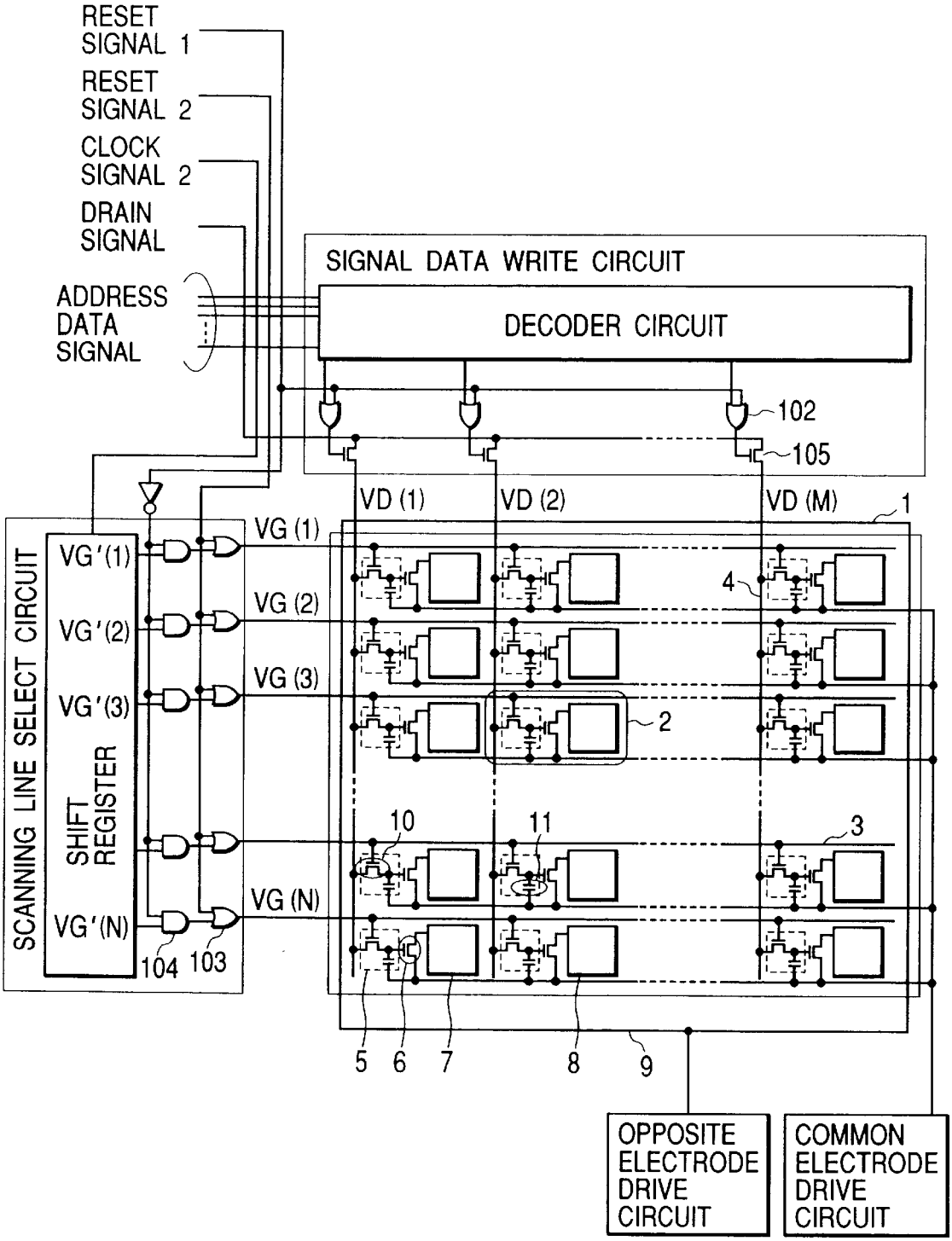
FIG. 14 is a block diagram representing the configuration of the fifth Embodiment according to the present invention.

FIG. 14 is a block diagram representing the firth Embodiment of a liquid crystal display according to the present invention.

The configuration of display unit 1 is the same as that in the first Embodiment. The signal data write circuit decodes the address data signal, and comprises a decoder circuit to select the signal electrode corresponding to the address data signal, an OR circuit 102 to issue the output of the decoder circuit output and OR signal of the reset signal 1, and a drain signal sampling TFT 105 to sample drain signals in response to the output of the OR circuit 102 and to issue them to the signal electrode. The scanning line selection circuit comprises a shift register to produce output in response to clock signal 2, an AND circuit 104 to produce AND signal VG' (j) between the output of the shift register and the inversion signal of the reset signal 1, and an OR circuit 103 to produce an OR signal between the output of the AND circuit 104 and output of the reset signal 2.

Common electrodes 8 are arranged in common for each row in parallel with scanning electrodes 3, and are connected with one another for connection of all pixels in common. Voltage VCOM is applied by the common electrode drive circuit. From the opposite electrode drive circuit, voltage VC is applied to opposite electrode 9 on the opposite substrate installed opposite to a display electrode 7 on the TFT substrate holding the liquid crystal in-between. Although not illustrated except for the opposite substrate, a phase plate and polarizing plate are arranged to constitute a reflector type liquid crystal display. In the present Embodiment, a quarter wave plate is used as a phase plate to ensure that black is displayed while voltage is applied to the liquid crystal, and white is displayed when not applied. Setting is made so that the optical axis of the phase plate and the absorption plate of the polarizing plate have an angle of 45 degrees.

Figure 15:
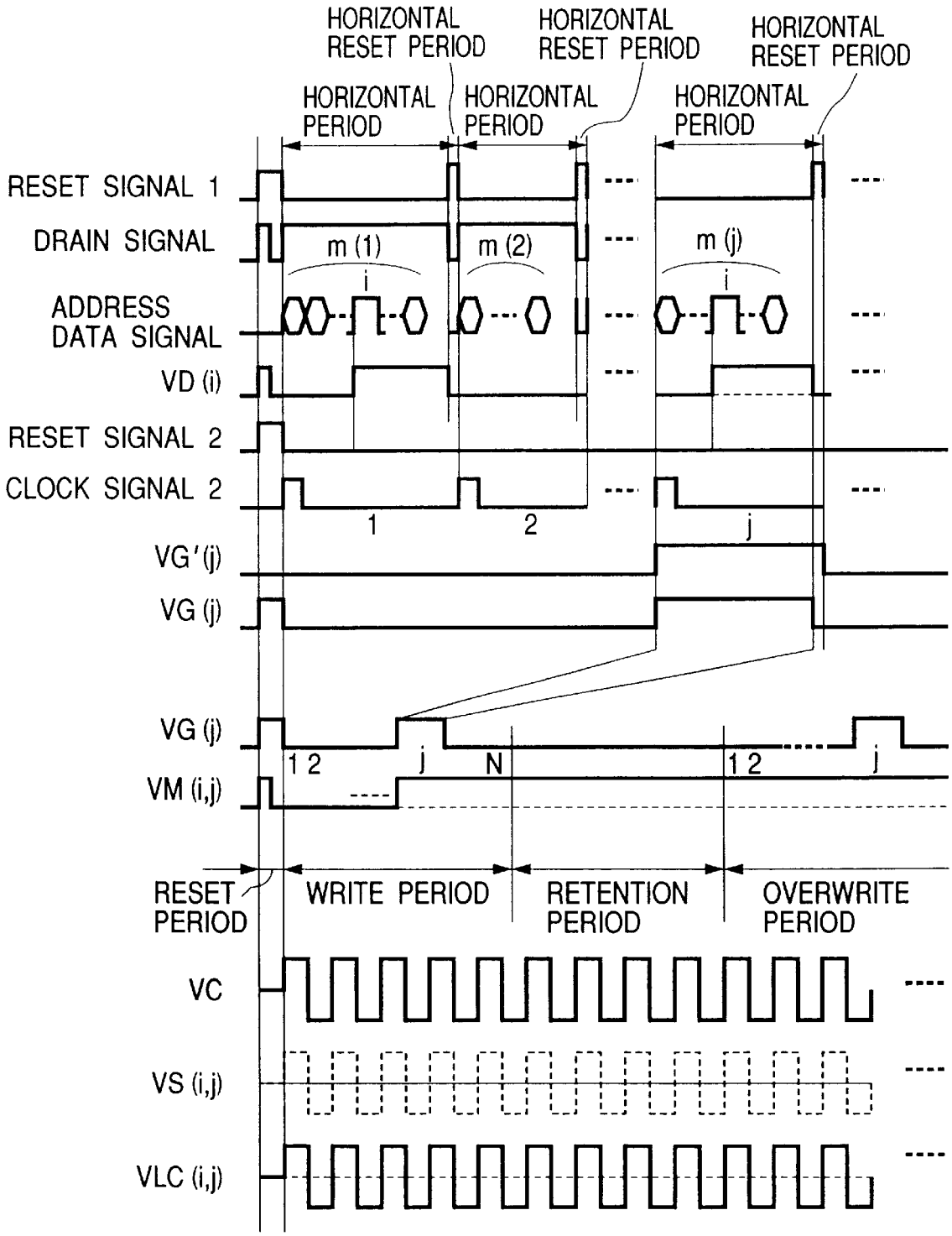
FIG. 15 represents the drive waveform according to the present invention of the fifth Embodiment.

The following describes the operation principle of the fourth Embodiment of the liquid crystal display according to the present invention comprising N-row×M-column pixels, using the drive waveform shown in FIG. 15. Here the display data signal voltage to write i-column by j-row pixels into the sampling capacitor of pixel (i, j) and pixel (i, j) is defined as V (i, j), where V (i, j) denotes either voltage level VDH or VDL shown in FIG. 6.

The liquid crystal display is driven by four periods; reset period, write period, retention period, and overwrite period. When the display has been switched, it is driven in the order of reset period, write period, retention period, and overwrite period, retention period, overwrite period, etc. If display does not change, it is driven in the order of retention period and overwrite period repeatedly. Reset period and write period are used only when display has been switched.

Reset signal 1 and reset signal 2 go high during the reset period. In this case, the outputs of the OR circuit 102 and OR circuit 103 go high despite the state of the shift register, etc. Since the output of OR circuit 102 is of high level, the drain signal is written into all signal electrodes through drain signal sampling TFT 105. Since the output of OR circuit 103 is at the high level, voltage of all scanning electrodes is VG(j)=VGH, and the display data signals of the signal electrodes are written into the sampling capacitor of all the pixels. The display data signal becomes VDL after having become VDH once during the reset period. So the switching TFTs of all pixels are turned off after having been turned on once. During the reset period, voltage VC of the opposite electrode is equal to voltage VCOM of the common electrode, so display electrode 7 is kept in the floating mode after voltage has become VCOM, thereby retaining voltage VCOM.

In the ensuing write period, voltage V(i, j) in response to display is written into the sampling capacitor of pixel (i ,j) while a.c. voltage is applied to the opposite electrode. In the reset period, V (i,j)=VDL is stored into all sampling capacitors, so the address of column i of the pixel where v (i, j)=VDH is written is input as an address data signal. Only the voltage of the sampling capacitor of the pixel where VDH is written is rewritten. This step reduces the write period.

In the write period, address data signals corresponding to address i of the pixel where VDH is written are input sequentially, and the signal to select the i-th signal electrode is issued from the decoder circuit. The drain signal voltage is VDH while address data signal in the j-th row is sent, and VDHs are sequentially issued into the signal electrode selected from the decoder circuit by drain signal sampling TFT 105. The initial VDL is stored in other signal electrodes. The address data signal stops after the above operation is repeated the number of times equivalent to the number m(j) of the pixels in the jth row where VDH is written. The voltage of the signal electrode is retained for a specified time. Then the reset signal 1 goes high, and drain signals are written into all signal electrodes through drain signal sampling TFT105. (This period is defined as a horizontal period). In this case, the drain signal is VDL, and VDL is written into all signal electrodes. This period is defined as a horizontal period. In this case, horizontal period changes according to m(j).

In the horizontal period, the shift register of the scanning line selection circuit selects the scanning electrode in response to clock signal 2 synchronized with the horizontal period. So the high level is output to VG' (J). Since AND signals between the inversion level of reset signal 1 and VG' (j) are issued to the scanning electrode, VG (j)=VGH is output in the horizontal period only when the reset signal is at the low level. The sampling TFT of the pixel (i,j) where voltage VG (j) of the connected scanning electrode has become VGH captures the voltage VD (i) of the connected signal electrode, and the voltage is retained to the sampling capacitor. VG (j)=VGL in the horizontal reset period, and the connected sampling TFT is turned off.

So the VD (i) in response to display is retained without single electrode voltage VDL written into the sampling capacitor. This operation is repeated N times which correspond to the number of the scanning electrodes, and the data of display data retention circuit of all pixels are rewritten, thereby terminating the write period.

Similarly to the case of the second Embodiment, voltages all signal electrodes are forcibly set to VDL at the end of each horizontal period in the present Embodiment, so said operation error resulting from data in the previous row does not occur.

Then the operations of drain signal, address data signal, clock signal 2, reset signal 1 and reset signal 2 are stopped, and a.c. voltage vC continues to be applied to the opposite electrode (retention period). Voltage VM retained in the sampling capacitor during this retention period varies according to the leakage of the sampling TFT and others. The length of the retention period is set to ensure that the voltage VDH written into the pixel where display is on is not less than voltage VMH throughout the retention period, and the voltage VDL written into the pixel where display is off does not exceed voltage VML throughout the retention period. Accordingly, during the retention period, the switching TFT of the pixel where display is on is in the state of connection (ON state), while the switching TFT of the pixel where display is off is in the state of non-connection (OFF state). So as shown in FIG. 15, the voltage VS of the display electrode of the pixel where display is on is equal to the voltage VCOM of the common electrode (solid line), whereas the voltage VS of the display electrode of the pixel where display is off is equal to the voltage VC of the opposite electrode (broken line). Since voltage VLC=VC−VS is applied to the liquid crystal, a.c. voltage with amplitude V0 is applied to the liquid crystal of the pixel where display is on (solid line), while voltage is not applied to the liquid crystal of the pixel where display is off (broken line).

The operation in the ensuring overwrite period is the same as that in the write period. Similarly to the second Embodiment, said operation error due to data in the previous row occurs in the overwrite period, unlike the case in the write period. However, it occurs in a very short time, without affecting display. In the overwrite period, when display data signal V (i, j)=VDH is overwritten into the sampling capacitor of the pixel in the j-th row in the j-th horizontal period, voltage VGL written to the signal electrode in the (j−1)-th horizontal reset period remains when the voltage of the j-th scanning electrode becomes VGH. Before the overwrite period, voltage not less than VMH is retained in the sampling capacitor. Immediately when the voltage of the j-th scanning electrode has become VGH, the switching TFT changes from ON to OFF state while a.c. voltage is applied to the opposite electrode. Then d.c. voltage will be applied to the liquid crystal as described above. In this case, However, V (i, j)=VDH is written immediately thereafter, the switching TFT is turned on. The d.c. voltage is applied to the liquid crystal only for a very short time, without affecting the display.

In the present Embodiment, VDH is output to the m(j) signal electrodes in the horizontal period of write period and overwrite period, wherein the number of signal electrodes corresponds to that of pixels where VDH is written. After this voltage is retained for a specified time, scanning electrode voltage is changed to VGL, and reset signal 1 is set to the high level. Immediately after VDH is issued to m(j) signal electrodes, scanning electrode voltage is changed to VGL, and the reset signal 1 is set to the high level. Operation is possible according to these steps. In this case, however, VDH is applied to m(j)-th signal electrodes only for a very short time. This requires the sampling TFT to have a high performance. If scanning electrode voltage is kept at VGH after VDH is applied to the m(j)-th signal electrode as in this Embodiment, and this state is retained for some time to prolong the time to write into the sampling capacitor, operation is possible even with the TFT of poorer performances.

As described above, use of the fifth Embodiment of the liquid crystal display according to the present invention reduces the write period and the time from appearance to disappearance of display. It also reduces power consumption.

Said second or third Embodiment almost completely eliminates the time for a new display to appear when display has switched. All the displays appear completely when display data signals V(i, j) have been written into the sampling capacitors of all pixels. So increase in the number of pixels will take a long time before all displays appear. Furthermore, a greater number of pixels means a longer write period. In the liquid crystal display according to the present invention, much time is required for writing. Increase in the number of pixels will result in increased power consumption.

By contrast, the present Embodiment provides a liquid crystal display characterized by high definition, lower power consumption, and a high speed display when display has switched.

Embodiment 6

Figure 16:
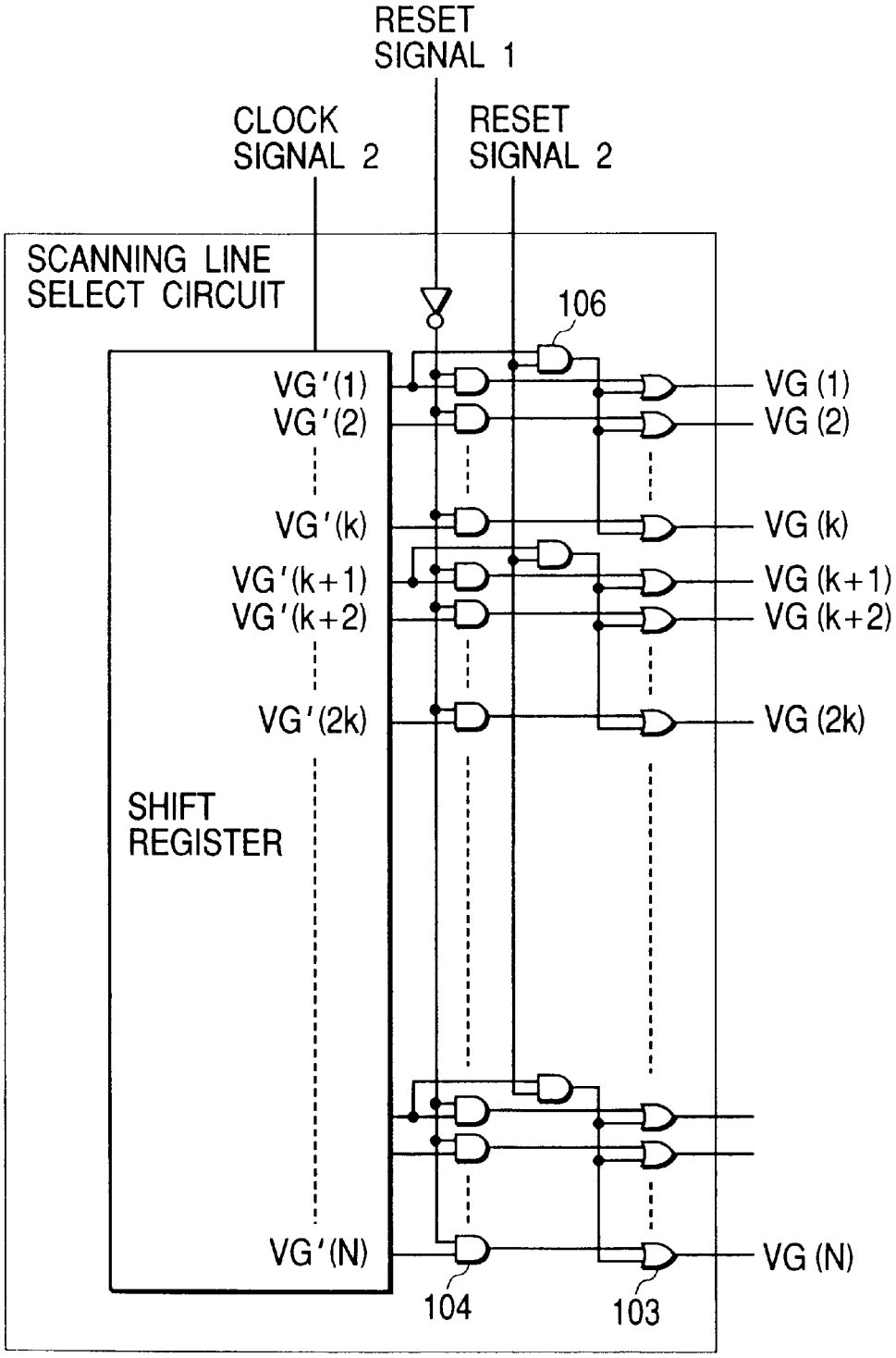
FIG. 16 is a block diagram representing the scanning line selection circuit of the sixth Embodiment according to the present invention.

FIG. 16 is a block diagram representing the scanning line selection circuit of the sixth Embodiment of the liquid crystal display according to the present invention. Display unit 1 formed on the TFT substrate and signal data write circuit are the same as those of the second Embodiment.

The scanning line selection circuit comprises;

(1) a shift register to produce output VG' (j) in response to clock signal 2, (2) an AND circuit 104 to produce AND signal VG' (j) between the output VG' (j) of the shift register and the inversion signal of the reset signal 1, (3) an AND circuit 106 to produce output VG' (mk+1) (m=0, 1, 2, . . .) of the (mk+1)-th shift register for each k-th and reset signal 2, and (4) an OR circuit 103 to output the OR signal between the output of the AND circuit 104 which is input by VG'(j) from j=mk+1 to j=(m+1) k-th rows (m=0, 1, 2, . . .), and the output of AND circuit 106 which is input by VG' (mk+1).

Common electrodes 8 are arranged in common for each row in parallel with scanning electrodes 3, and are connected with one another for connection of all pixels in common. Voltage VCOM is applied by the common electrode drive circuit. From the opposite electrode drive circuit, voltage VC is applied to opposite electrode 9 on the opposite substrate installed opposite to a display electrode 7 on the TFT substrate holding the liquid crystal in-between. Although not illustrated except for the opposite substrate, a phase plate and polarizing plate are arranged to constitute a reflector type liquid crystal display. In the present Embodiment, a quarter wave plate is used as a phase plate to ensure that black is displayed while voltage is applied to the liquid crystal, and white is displayed when not applied. Setting is made so that the optical axis of the phase plate and the absorption plate of the polarizing plate have an angle of 45 degrees.

Figure 17:
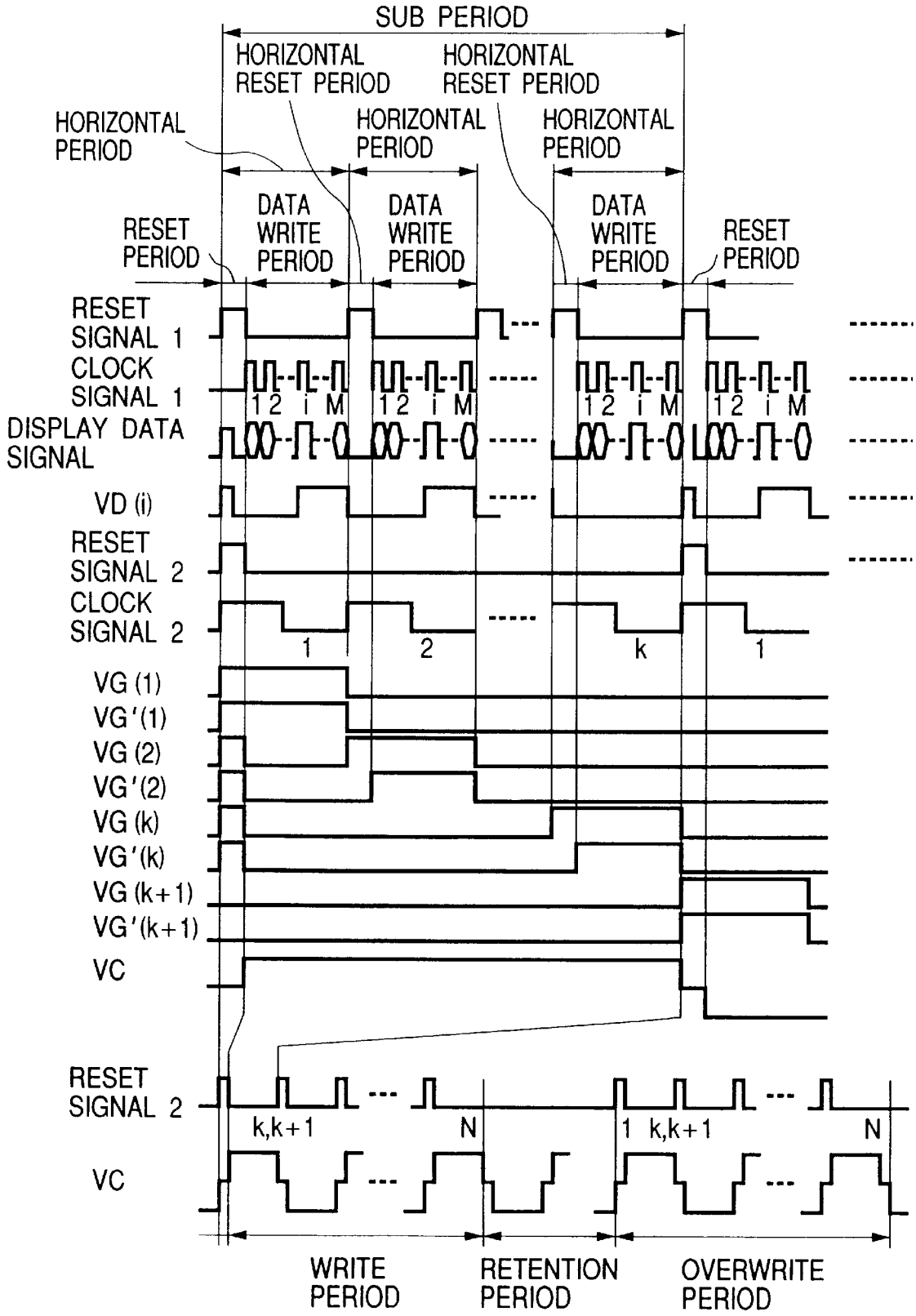
FIG. 17 represents the drive waveform according to the present invention of the sixth Embodiment.

The following describes the operation principle of the sixth Embodiment of the liquid crystal display according to the present invention comprising N-row×M-column pixels, using the drive waveform shown in FIG. 17. Here the display data signal voltage to write i-column by j-row pixels into the sampling capacitor of pixel (i, j) and pixel (i, j) is defined as V (i, j), where V (i, j) denotes either voltage level VDH or VDL shown in FIG. 6.

The liquid crystal display is driven by two periods; write period and retention period. When display has switched, it is driven in the order of write period, retention period, overwrite period, retention period, etc. If display does not change, it is driven in the order of write period and retention period repeatedly. There is not difference between the write period and overwrite period, unlike the Embodiments mentioned above. The same write period and drive waveform are applied both when display has switched to rewrite sampling capacitor voltage and when the voltage reduced by leakage is replenished.

The write period is divided into said m sub-periods, and voltage is captured into the sampling capacitors of k-row pixels in one sub-period. This sub-period is repeated m times to capture voltages into the sampling capacitors of all m×k=N rows. The sub-period consists of the periods from the first to k-th horizontal periods.

The first horizontal period comprises the reset period and data write period. Reset signal 1 and reset signal 2 go high during the reset period. Since reset signal 1 is high, the output of OR circuit 102 is high, independently of the state of the shift register of the signal data write circuit. Since the output of the OR circuit 102 is high, display data signal is into all signal electrodes through the display data sampling TFT101. Meanwhile, since reset signal 2 is high level, the output voltage VG (j) from j=mk+1 to j=(m+1) k-th row (m=0, 1, 2, . . .) of the scanning selection circuit is high only when the output VG' (k+1) of shift register is high. Accordingly, display data signals written into all signal electrodes in this case are written into the sampling capacitors from mk+1st row to (m+1) k-th row. During the reset period, display data signal becomes VDL after becoming VDH. So the switching TFT of the pixels from mk+1st row to (m+1) k-th row is turned off and reset after having been turned on once.

During the reset period, the voltage VC of the opposite electrode is made equal to the voltage VCOM of the common electrode, so display electrode 7 is in the floating mode after voltage becomes VCOM, and voltage VCOM is retained. In the second Embodiment, voltages of the sampling capacitors of pixels in all rows are reset. In the present Embodiment, resetting is made in separate m-steps for every k rows, as described above.

In the ensuing data write period, voltage V(i, j) in conformity to display is written into the sampling capacitor of pixel (i, j) in the mk+1st row while a.c. voltage is applied to the opposite electrode. In this case, the switching TFT of the pixel in mk+1st row is off during the reset period, so there is no change to the OFF from ON state where d.c. voltage is applied to the liquid crystal, as described with reference to FIG. 7.

In the data write period, the signals which select signal electrodes sequentially are output from the shift register in response to clock signal 1. The display data signal is synchronous with clock signal 1, and the corresponding display data signal V (i, j) is output when the specified signal electrode is selected. Consequently, display data signals VD (i) (i=1 through N) are output sequentially to the specified signal electrode by the display data signal sampling TFT 101. VD(i')=VDH is issued to the signal electrode connected to the pixel (i', j) where display is on, while VD(i")=VDL is output to the signal electrode connected to the pixel (i", j) where display is off. (See FIG. 6). The data write period terminates when above operations have been repeated M times.

The second through k-th horizontal periods comprise the horizontal reset period and data write period. In the horizontal reset period, reset signal 1 goes high, and display data signals are written into all signal electrodes via the display data signal sampling TFT 101. In this case, the display data signal is low (VDL), and the VDL is written into all signal electrodes. In the horizontal reset period, the reset signal 2 is low unlike the reset period. So voltage VG(j) of the scanning electrode=VGL. VDL written into the signal electrode is not written into the sampling capacitor. After that, display data for one row is written into the signal electrode in data write period, similarly to the case of the first horizontal period.

In the horizontal period, the shift register of the scanning line selection circuit outputs high level to the VG'(j) in order to select the scanning electrode in response to clock signal 2 synchronized with the horizontal period. (j=mk+j', m=0, 1, 2, . . . , j'=1, 2, . . . k) Since the OR signal of the AND signal between the inversion signal of the reset signal 1 and VG' (j), and the AND signal between output VG' (mk+1) of the shift register and reset signal 2 is output to the scanning electrode, VG (j)=VGH is output to the scanning electrode in the j=mk+j'-th row in the reset period of the first horizontal period when the reset signal 2 is high and output VG' of the shift register (mk+1) is high, and in the data write period of the j'-th horizontal period when reset signal 1 is low and output VG' (mk+j') of the shift register is high. The sampling TFT of the pixel (i, j) where the voltage VG (j) of the connected scanning electrode has become VGH captures the voltage VD(i) of the connected signal electrode, and retains the voltage in the sampling capacitor. Since VG (j)=VGL in the horizontal reset period, the connected sampling TFT is turned off and VD (i) in conformity to display is retrained, without the voltage VDL of the signal electrode being written into the sampling capacitor 11 in the horizontal reset period.

As described above, the operation error caused by data in the preceding row can be avoided by assigning the horizontal reset period where the voltages of all signal electrodes is made VDL, before VGH is output to the scanning electrode, similarly to the case of the second Embodiment.

In the retention period, the operations of clock signal 1, display data signal, clock signal 2, reset signal 1, and reset signal 2 are stopped, and a.c. voltage VC continues to be applied to the opposite electrode.

Other Embodiments described above prevent the picture quality from being deteriorated by unwanted d.c. voltage applied to the liquid crystal by adopting the drive method which does not change the switching TFT from ON to OFF state, while a.c. voltage is applied to the opposite electrode. However, when d.c. voltage is applied to the liquid crystal due to some influence on the pixel where display is off, the switching TFT remains off so long as the display s off, and there is no rapid decrease in d.c. voltage applied to the liquid crystal. This may occur, for example, when the display switch has been turned on.

In the present Embodiment, the switching TFT turns on once in the write period when the voltage of the opposite electrode agrees with that of the common electrode independently of display. The pixel electrode is connected to the common electrode. Consequently, even if d.c. voltage is applied to the liquid crystal layer, it will be disappear in one write period, without raising any problem, as described above.

The drive frequency of the liquid crystal is preferred to be 60 Hz or more when flicker problems are taken into account. In the present Embodiment, the polarity of the opposite electrode voltage VC is reversed for each sub-period. So the sub-period is preferred to be 16.6 ms or less in order to drive the liquid crystal at 60 Hz or more.

The present invention provides a liquid crystal display and drive method thereof characterized lower power consumption and high speed display switching, where display is made by keeping the pixel electrode in the floating mode. It also provides a liquid crystal display with a simple circuit configuration and drive method thereof characterized lower power consumption and high speed display switching, where display is made by keeping the pixel electrode in the floating mode.

What is claimed is:

1. A liquid crystal display comprising:

(1) a switching element connected to a display data retention circuit, a common electrode, and a display electrode, for controlling a connection between the common electrode and the display electrode according to a voltage retained in the display data retention circuit; and (2) an opposite electrode installed opposite to the display electrode, having applied thereto an AC voltage vibrating in response to a voltage of the common electrode;

wherein a liquid crystal is held between the display electrode and the opposite electrode;

wherein display is performed based on the fact that an AC voltage is applied to the opposite electrode to drive the liquid crystal when the switching element establishes a connection between the display electrode and the common electrode, and the AC voltage is not applied to the opposite electrode when the switching element releases the connection between the display electrode and the common electrode; and wherein the switching element changes from connection between the display electrode and the common electrode to release of the connection under a condition that the AC voltage applied to the opposite electrode is stopped, and respective voltages of the opposite electrode, the display electrode, and the common electrode are made substantially the same.

2. A liquid crystal display according to claim 1, further comprising:

a signal data write circuit arranged to apply voltage to the corresponding signal electrode; and a scanning selection circuit arrange to apply voltage to the corresponding scanning electrode.

3. A liquid crystal display according to claim 2, wherein the signal data write circuit comprises: (1) a shift register to produce an output in response to a clock signal, (2) an OR circuit to issue an OR signal of an output of the shift register and a reset signal, and (3) a thin film transistor to sample display data in response to an output of the OR circuit and to output sampled data to the corresponding signal electrode.

4. A liquid crystal display according to claim 2, wherein the scanning selection circuit comprises: (1) a shift register to produce an output in response to a clock signal, (2) an AND circuit to issue AND signals between an output of the shift register and an inverse of a first reset signal and (3) an OR circuit to issue an OR signal between an output of the AND circuit and a second reset signal.

5. A liquid crystal display according to claim 2, wherein the signal data write circuit comprises: (1) a decoder circuit to decode address data signals and to select signal electrodes corresponding to address data signals, (2) an OR circuit to issue OR signals of an output of the decoder circuit and a first reset signal, and (3) a thin film transistor to sample drain signals in response to an output of the OR circuit and to output sampled signals to the corresponding signal electrode; and wherein the scanning selection circuit comprises: (1) a shift register, (2) an AND circuit to issue AND signals between an output of the shift register and an inverse of the first reset signal and (3) an OR circuit to issue OR signals between an output of the AND circuit and a second reset signal.

6. A liquid crystal display comprising:

(1) a pair of substrates, at least one of which is transparent;

(2) a liquid crystal layer held between the substrates;

(3) multiple scanning electrodes provided on one of the substrates;

(4) multiple signal electrodes crossing the multiple scanning electrodes;

(5) a display data retention circuit connected to the corresponding scanning electrode and signal electrode provided at crossing points of the multiple scanning electrodes and the multiple signal electrodes on one of the substrates, to capture and retain a voltage of the signal electrode corresponding to display in response to the voltage of the corresponding scanning electrode;

(6) a switching element connected to the display data retention circuit, a common electrode, and a display electrode, to control a connection between the common electrode and the display electrode in response to a voltage retained in the display data retention circuit; and (7) an opposite electrode provided on another one of a the substrates opposite to the display electrode, having applied thereto an AC voltage vibrating in response to the voltage of the common electrode;

wherein the liquid crystal layer is held between the display electrode and the opposite electrode provided on the substrates respectively;

wherein display is performed based on the fact that an AC voltage is applied to the opposite electrode to drive the liquid crystal layer when the switching element establishes a connection between the display electrode and the common electrode, and the AC voltage is not applied to the opposite electrode when the switching element releases the connection between the display electrode and the common electrode; and wherein the AC voltage is applied to the opposite electrode after rewriting the voltage retained in the display data retention circuit under a condition that voltages of all display electrodes are made substantially the same as the voltage of the common electrode, and the voltage of the opposite electrode is made substantially the same as the voltage of the common electrode.

7. A liquid crystal display according to claim 6, wherein drive is made by sequential repetition of:

(1) a write period to write the voltage in response to the display of the display data retention circuit, (2) a retention period to retain the state of the display data retention circuit when the AC voltage is applied to the opposite electrode, and (3) an overwrite period to overwrite written display data;

wherein the voltage according to display is written to the display data retention circuit under a condition that voltages of all display electrodes are made substantially the same as the voltage of the common electrode, and the voltage of the opposite electrode is made substantially the same as the voltage of the common electrode during said write period and said overwrite period.

8. A liquid crystal display comprising:

(1) a pair of substrates at least one of which is transparent;

(2) a liquid crystal layer held between the substrates;

(3) multiple scanning electrodes provided on one of the substrates;

(4) multiple signal electrodes crossing the multiple scanning electrodes;

(5) a display data retention circuit connected to the corresponding scanning electrode and signal electrode provided at crossing points of the multiple scanning electrodes and the multiple signal electrodes provided on one of the substrates, to capture and retain the voltage of the signal electrode corresponding to display in response to the voltage of the corresponding scanning electrode;

(6) a switching element connected to the display data retention circuit, a common electrode, and a display electrode, to control a connection between the common electrode and the display electrode in response to a voltage retained in the display data retention circuit; and (7) an opposite electrode provided on another one of the substrates opposite to the display electrode, having applied thereto an AC voltage vibrating in response to the voltage of the common electrode;

wherein the liquid crystal layer is held between the display electrode and the opposite electrode provided on the substrates respectively;

wherein display is performed based on the fact that an AC voltage is applied to the opposite electrode when the switching element establishes a connection between the display electrode and the common electrode, and the AC voltage is not applied to the opposite electrode when the switching element releases the connection between the display electrode and the common electrode; and wherein the voltage retained in the display data retention circuit is rewritten upon switching of display, when the AC voltage is applied to the opposite electrode, subsequent to the switching element releasing the connection between the display electrode and the common electrode, after voltages of all display electrodes are made substantially the same as the voltage of the common electrode, and the voltage of the opposite electrode is made substantially the same as the voltage of the common electrode.

9. A liquid crystal display according to claim 7, wherein drive is made by sequential repetition of:

(1) a write period to write the voltage in response to the display of the display data retention circuit, (2) a retention period to retain the state of the display data retention circuit when the AC voltage is applied to the opposite electrode, and (3) an overwrite period to overwrite written display data;

wherein the voltage is written to the display data retention circuit in a pixel area for at least one row during said write period and said overwrite period, when the AC voltage vibrating in response to the voltage of the common electrode is applied to the opposite electrode, subsequent to releasing the connection between the display electrode and the common electrode in said pixel area for at least one row after voltages of all display electrodes are made substantially the same as the voltage of the common electrode in said pixel area for at least one row, and the voltage of the opposite electrode is made substantially the same as the voltage of the common electrode.

10. A liquid crystal display according to claim 8 or 9 wherein a signal data write circuit is provided to apply voltage to the signal electrode, comprising: (1) a shift register, (2) an OR circuit to issue an OR signal of an output of the shift register output and a first reset signal, and (3) a thin film transistor to sample display data signals in response to an output of the OR circuit and to output sampled signals to the signal electrode; while a scanning selection circuit is provided to apply voltage to the scanning electrode, comprising: (1) a shift register and (2) an OR circuit to issue an OR signal of an output of the shift register and a second reset signal.

11. A drive method for a liquid crystal display comprising:

(1) a switching element connected to a display data retention circuit, a common electrode, and a display electrode, to establish a connection between the common electrode and the display electrode according to a voltage retained in the display data retention circuit; and (2) an opposite electrode installed opposite to the display electrode, to receive application of an AC voltage vibrating in response to the voltage of the common electrode;

wherein a liquid crystal is held between the display electrode and the opposite electrode;

wherein display is performed when an AC voltage is applied to the opposite electrode to drive the liquid crystal when the switching element establishes a connection between the display electrode and the common electrode, and when the AC voltage is not applied to the opposite electrode when the switching element releases the connection between the display electrode and the common electrode; and wherein the switching element changes from connection between the display electrode and the common electrode to release of the connection under a condition that the AC voltage applied to the opposite electrode is stopped, and respective voltages of the opposite electrode, the display electrode, and the common electrode are made substantially the same.

12. A liquid crystal display according to any one of claims 1 to 9, wherein the display electrode provided on one of the substrates, via an insulation film, comprises a light reflecting component, and wherein the display electrode and the switching element are connected, via a connector hole provided on the insulation film.

13. A liquid crystal display according to claim 12, wherein the display data retention circuit, the switching element, the scanning electrode, and the signal electrode are placed overlapped with the display electrode between one of the substrates and the display electrode on another one of the substrates.

14. A liquid crystal display according to claim 6, 8 or 9, wherein the signal electrode voltages are changed in one operation in synchronism with application of a pulse voltage to the corresponding scanning electrode, when voltage is written to the display data retention circuit.

15. A liquid crystal display according to claim 6, 8 or 9, wherein, when voltage is written to the display data retention circuit, a reset voltage which changes the state of the switching element to release the connection between the display electrode and the common electrode is applied to all signal electrodes, after the display data retention circuit of a pixel area for one row has been made not to capture voltage from the signal electrode, subsequent to the voltage of the signal electrode having been captured and held in the display data retention circuit of said pixel area for one row.

16. A liquid crystal display according to claim 15, wherein, when voltage according to display is applied to the signal electrode, the reset voltage is retained by allowing voltage to be written only to the signal electrode connected to the pixel which sets the switching element to establish connection between the display electrode and the common electrode, without allowing voltage to be written to the signal electrode connected to the pixel which sets the switching element to release connection between the display electrode and the common electrode.

17. A liquid crystal display according to claim 16, wherein a signal data write circuit is provided to apply voltage to the signal electrode, comprising: (1) a decoder circuit to decode address data signals and to select signal electrodes corresponding to address data signals, (2) an OR circuit to issue OR signals of an output of the decoder circuit and a first reset signal, and (3) a thin film transistor to sample drain signals in response to an output of the OR circuit and to output sampled signals to the signal electrode; while a scanning selection circuit is provided to apply voltage to the scanning electrode, comprising: (1) a shift register, (2) an AND circuit to issue AND signals between an output of the shift register and an inverse of the first reset signal and (3) an OR circuit to issue OR signals between an output of the AND circuit and a second reset signal.

18. A liquid crystal display according to claim 15, wherein a signal data write circuit is provided to apply voltage to the signal electrode, comprising: (1) a shift register, (2) an OR circuit to issue an OR signal of an output of the shift register and a first reset signal, and (3) a thin film transistor to sample display data signals in response to an output of the OR circuit and to output sampled signals to the signal electrode; while a scanning selection circuit is provided to apply voltage to the scanning electrode, comprising: (1) a shift register, (2) an AND circuit to issue AND signals between an output of the shift register and an inverse of the first reset signal and (3) an OR circuit to issue an OR signal between an output of the AND circuit and a second reset signal.

19. A liquid crystal display according to claim 6, 8 or 9, wherein, when voltage is written to the display data retention circuit, the display data retention circuit of a pixel area for one row captures the voltage of the signal electrode, after the signal electrode voltage has been rewritten into the voltage to be written to the display data retention circuit of said pixel area for one row, when the display data retention circuit does not capture the signal electrode voltage.

20. A liquid crystal display according to claim 19, wherein a signal data write circuit is provided to apply voltage to the signal electrode, comprising: (1) a shift register, (2) an OR circuit to issue an OR signal of an output of the shift register and a first reset signal, and (3) a thin film transistor to sample display data signals in response to an output of the OR circuit and to output sampled signals to the signal electrode; while a scanning selection circuit is provided to apply voltage to the scanning electrode, comprising: (1) a shift register, (2) an AND circuit to issue an AND signal between an output of the shift register and a control signal, and (3) an OR circuit to issue an OR signal between an output of the AND circuit and a second reset signal.

* * * * *